US011542825B2

(12) United States Patent
Hauswirth et al.

(10) Patent No.: US 11,542,825 B2
(45) Date of Patent: Jan. 3, 2023

(54) GAS TURBINE RING ASSEMBLY COMPRISING RING SEGMENTS HAVING INTEGRATED INTERCONNECTING SEAL

(71) Applicant: DOOSAN ENERBILITY CO., LTD., Changwon-si (KR)

(72) Inventors: Simon Hauswirth, Baden (CH); Wade Beaumont, Baden (CH); Vincent Galoul, Baden (CH); Richard Jones, Baden (CH); Yunchang Jang, Baden (CH)

(73) Assignee: DOOSAN ENERBNITY CO., LTD., Changwon (KR)

( * ) Notice: Subject to any disclaimer, the term of this patent is extended or adjusted under 35 U.S.C. 154(b) by 0 days.

(21) Appl. No.: 17/520,756

(22) Filed: Nov. 8, 2021

(65) Prior Publication Data

US 2022/0213799 A1 Jul. 7, 2022

(51) Int. Cl.

| | |
|---|---|
| ***F01D 11/00*** | (2006.01) |
| ***F01D 25/24*** | (2006.01) |
| ***F01D 11/08*** | (2006.01) |

(52) U.S. Cl.

CPC ..... *F01D 11/005* (2013.01); *F01D 11/08* (2013.01); *F01D 25/24* (2013.01); *F05D 2240/11* (2013.01); *F05D 2240/55* (2013.01)

(58) Field of Classification Search

CPC ..... F01D 25/24; F01D 25/246; F01D 11/005; F01D 11/08; F05D 2240/55; F05D 2240/11; F05D 2260/36; Y02T 50/60

See application file for complete search history.

(56) References Cited

U.S. PATENT DOCUMENTS

| | | | | |
|---|---|---|---|---|
| 8,784,041 | B2 * | 7/2014 | Durocher | B22F 5/009 164/112 |
| 9,079,245 | B2 * | 7/2015 | Durocher | B22F 5/009 |
| 2013/0051987 | A1 | 2/2013 | Durocher | |
| 2013/0051989 | A1 | 2/2013 | Durocher | |
| 2019/0271234 | A1 * | 9/2019 | Campbell | F01D 5/284 |
| 2020/0063578 | A1 | 2/2020 | Notarnicola | |
| 2021/0277791 | A1 * | 9/2021 | Schmidt-Petersen | F01D 11/08 |

FOREIGN PATENT DOCUMENTS

DE 102013219024 A1 4/2015

OTHER PUBLICATIONS

DE OA dated May 3, 2022.

* cited by examiner

*Primary Examiner* — Igor Kershteyn
(74) *Attorney, Agent, or Firm* — Harvest IP Law LLP

(57) ABSTRACT

The present invention presents a ring assembly 1 disposed radially outwardly of an array of circumferentially arranged blades 38 of a gas turbine engine rotor R. The ring assembly 1 includes ring segments 2 disposed circumferentially one adjacent to another and having a first circumferential end 2*a* and a second circumferential end 2*b* circumferentially spaced apart from each other. The first end 2*a* of a ring segment 2 and the second end 2*b* of an adjacent ring segment 2 of the plurality of ring segments 2 are arranged facing each other. An integrally formed projecting seal part 92 is formed at the first end 2*a*. An integrally formed receiving seal part 94 is formed at the second end 2*b* facing the first end 2*a*. The receiving seal part 94 receives the projecting seal part 92 to form a mating connection between the ring segment 2 and the adjacent ring segment 2. A gas turbine engine including the ring assembly 1 is also provided. Furthermore, a method of manufacturing the ring segment 2 of the ring assembly 1 is also provided.

20 Claims, 22 Drawing Sheets

GAS TURBINE RING ASSEMBLY COMPRISING RING SEGMENTS HAVING INTEGRATED INTERCONNECTING SEAL

CROSS-REFERENCE TO RELATED APPLICATIONS

This application claims priority to German Patent Application No. 10 2021 100 071.8, filed on Jan. 5, 2021, the disclosure of which is incorporated herein by reference in its entirety.

FIELD OF THE INVENTION

The present invention relates to gas turbines, and more particularly to techniques for sealing of adjacent ring segments of ring assemblies of a gas turbine.

BACKGROUND OF THE INVENTION

Gas turbine engines include multiple stages of blades and vanes alternatingly arranged along an axial direction of the gas turbine engine. Conventionally, a ring assembly, also referred to as shroud or shroud ring or annular shroud or flow path ring, is disposed circumferentially about a rotational axis of gas turbine engine and radially outwardly of the rotating turbine blades, which means spaced apart and facing the blade tips of the turbine blades.

The ring assembly includes a plurality of stationary ring segments that when arranged circumferentially next to each other form the complete ring assembly. The ring assembly formed by the plurality of the ring segments defines an outer boundary of hot gas path along which the hot gas flows.

FIG. 4B schematically illustrates parts of two adjacent conventional ring segments 2' circumferentially arranged with respect to the rotational axis 20, also referred to as central axis 20, of the gas turbine engine. FIG. 5A schematically depicts structure of the conventional ring segments 2'. The ring segment 2' has a radially inner surface 2*x*', also referred to as gas path surface 2*x*', facing radially inwardly and defining the hot gas path 5 a radially outer surface 2*e*', a first and a second axial surfaces 2*m*', 2*n*' wherein 2*m*' and 2*n*' being axially spaced apart from each other, and a first end 2*a*' (also referred to as first circumferential end 2*a*') and a second end 2*b*' (also referred to as second circumferential end 2*b*') circumferentially spaced apart from each other, with respect to the rotational axis 20 of the gas turbine engine.

As shown in FIG. 4B, when the ring segments 2' are assembled to form the ring assembly, junctions or gaps G between adjacent ring segments 2' are required to be sealed to avoid leakage of hot gas from the hot gas path 5 to radially outwardly across the ring assembly—because such leakage of the hot gas would be detrimental to engine efficiency and may also cause undesired effects by heating up sections of the casing or other components disposed radially outward of the ring assembly.

Furthermore, since at least the gas path surface 2*x*' of the ring segment 2' defines the hot gas path 5 or is disposed around the hot gas path 5, the ring segments 2 are often cooled, by supplying cooling air from a radially outward position of the ring assembly towards the ring segments 2'. Therefore, sealing of the junction or gap G between the ring segments 2' may also be required to avoid unintended leakage of cooling air from a radially outward position of the ring assembly into the hot gas flow path 5.

Conventionally, to seal the junction or gap G between the ring segments 2', a groove GR, as shown in FIG. 5A, is formed at each of the circumferential ends 2*a*', 2*b*', and a sealing element S', as shown in FIG. 4B, is inserted into both grooves GR of the facing circumferential ends 2*a*', 2*b*' of adjacent ring segments 2'. The sealing element S' is generally formed as a sealing plate S'—one end of which is inserted into the groove GR of one ring segment 2' and an opposite end of which is inserted into the groove GR of the adjacent ring segment 2'. The high pressure in the hot gas flow path 5 during operation of the gas turbine presses the sealing element S' against the walls defining the grooves GR thereby achieving sealing of the gap or junction G.

However, the above-described conventional sealing technique suffers from one or more disadvantages. For example, because conventional sealing elements are additional elements that need to be separately fabricated and assembled, cost, time and effort required for manufacturing and assembly of the gas turbine are increased. Also, the conventional sealing elements may be wrongly inserted into one or both of the facing grooves during assembly, or may become loose or fall out from one or both of the facing grooves during operation—thereby compromising the sealing. Also, since the conventional sealing elements are manufactured separately than the ring segments, a slight mismatch in dimensions may lead to unsatisfactory sealing. The slight mismatch may result from use of separate manufacturing processes for the sealing elements and the ring segments.

SUMMARY OF THE INVENTION

Advantageous embodiments of the present invention are provided in independent claims and also in dependent claims. Features of independent claim may be combined with features of claims dependent on the independent claim, and features of dependent claims can be combined with each other.

According to an embodiment of the present invention, a ring assembly for being disposed radially outwardly of, or for surrounding or encircling, an array of circumferentially arranged blades of a rotor of a gas turbine engine is presented.

The ring assembly includes a plurality of ring segments disposed circumferentially one adjacent to another. Each ring segment has a radially inner gas path surface and a radially outer surface opposite to the gas path surface, and a first circumferential end and a second circumferential end circumferentially spaced apart from each other. The first circumferential end and the second circumferential end may be referred to as a first end and a second end.

When positioned in the ring assembly, the first end of a ring segment and the second end of an adjacent ring segment from among the plurality of ring segments may be arranged facing each other. An integrally formed projecting seal part may be formed at the first end of one ring segment. An integrally formed receiving seal part may be formed at the second end of an adjacent segment, which faces the first end.

The receiving seal part may receive the projecting seal part thereby forming a mating connection or interlocking connection between the ring segment and the adjacent ring segment.

The projecting seal part and the receiving seal part may be mutually corresponding or may correspond to each other. In other words, a shape and/or size and/or dimension and/or layout and/or position of the projecting seal part and the receiving seal part may match each other or comply with each other, such that the projecting seal part is received into the receiving seal, when the projecting seal part of one ring segment and the receiving seal of another ring segment are disposed adjacent to each other and moved relatively towards each other, preferably along the circumferential direction.

The projecting seal part of one ring segment may be slid into the receiving seal of another ring segment, preferably by relative sliding motion along the circumferential direction.

The projecting seal part and the receiving seal part may be complementary to each other, such that the projecting seal part may be plugged into the receiving seal part, preferably such that the radially inner gas path surface of the one ring segment and the radially inner gas path surface of the another ring segment may be disposed adjacent to each other, or preferably adjoining each other, or also preferably flush with each other.

The projecting seal part and the receiving seal part may be positioned at the first end and the second end facing the first end such that the projecting seal part and the receiving seal part directly face each other, when the first end and the second end facing the first end are disposed next to each other along the circumferential direction.

The projecting seal part and the corresponding receiving seal part may have a longitudinal shape and may extend along an axial direction. The projecting seal part and the corresponding receiving seal part may extend along or across an axial length of the ring segment, preferably may extend along an entire axial length of the ring segment.

The integrally formed projecting seal part may be formed at the first end of one ring segment and the integrally formed receiving seal part may be formed at the second end of adjacent ring segment.

All of the ring segments of the ring assembly may be identical to one another.

The integrally formed projecting seal part may be formed at the first end of each of the ring segments.

The integrally formed receiving seal part may be formed at the second end of each of the ring segments.

The first end may include a first axial edge and a second axial edge that are axially spaced apart from each other.

The projecting seal part or at least a first part of the projecting seal part may be formed to extend from the first axial edge to the second axial edge of the first end.

The second end may include a first axial edge and a second axial edge that are axially spaced apart from each other.

The receiving seal part or at least a first part of the receiving seal part may extend from the first axial edge to the second axial edge of the second end. The receiving seal part may correspond to the projecting seal part or the first part of the projecting seal part.

The first end may include a first radial edge and a second radial edge that are radially spaced apart from each other.

At least a second part of the projecting seal part may extend towards the first radial edge and/or towards the second radial edge of the first end.

The second end may include a first radial edge and a second radial edge that are radially spaced apart from each other.

At least a second part of the receiving seal part may extend towards the first radial edge and/or towards the second radial edge of the second end, and may correspond to the second part of the projecting seal part.

The first part and the second part of the projecting seal part may intersect each other. The first part and the second part of the projecting seal may join each other, in other words, the second part may extend from the first part.

Similarly, the first part and the second part of the receiving seal part may intersect each other. The first part and the second part of the receiving seal part may join each other, in other words, the second part may extend from the first part. The first part and the second part of the receiving seal part may correspond to the first part and the second part of the projecting seal part.

The projecting seal part and/or the receiving seal part may be curved following a circumferential direction along which the ring segments are disposed.

A thickness of the projecting seal part may be lesser than a thickness of the first end of the ring segment at which the projecting seal part is formed.

A thickness of the receiving seal part may be lesser than a thickness of the second end of the ring segment at which the receiving seal part is formed.

The thicknesses may be measured along a radial direction.

The projecting seal part may include or may be formed as at least one protruding lip or rail emanating outwardly from a circumferential side surface at the first end.

The receiving seal part may include or may be formed as at least one receiving grooves recessed inwardly from a circumferential side surface at the second end.

The at least one receiving groove may correspond to the at least one protruding lip of the projecting seal part, such that when the projecting seal part and the receiving seal part are adjacently disposed in the circumferential direction, the protruding lip is received into the receiving groove.

The projecting seal part, e.g. the protruding lip or rail, may be shaped to conform to the outline or form of the first end, preferably of the circumferential side surface at the first end. The receiving seal part e.g. the receiving groove may be shaped corresponding to the shape of the projecting seal part.

The projecting seal part, e.g. the protruding lip or rail, may be shaped corresponding to and disposed along a skeleton or topological skeleton of the first end, preferably of the circumferential side surface at the first end. The receiving seal part e.g. the receiving groove may be shaped corresponding to the shape of the projecting seal part.

The projecting seal part, e.g. the protruding lip or rail, may be extend along the entire skeleton or topological skeleton of the first end, preferably of the circumferential side surface at the first end. The receiving seal part e.g. the receiving groove may be shaped corresponding to the shape of the projecting seal part.

The skeleton or topological skeleton of the projecting seal part and the skeleton or topological skeleton of the first end may overlap and correspond to skeleton or topological skeleton of the circumferential side surface at the first end.

The ring segment may include one or more fixing parts, to fix the ring segment to the ring carrier. The fixing part may extend circumferentially and may include circumferential surfaces at the first end and at the second end. The circumferential surface of the fixing part at the first end may be flush with the circumferential side surface at the first end to form a continuous circumferential side surface at the first end. Similarly, the circumferential surface of the fixing part at the second end may be flush with the circumferential side surface at the second end to form a continuous circumferential side surface at the second end.

The projecting seal part, e.g. the protruding lip or rail, may be shaped corresponding to or disposed along a skeleton or topological skeleton of the first end, preferably of the continuous circumferential side surface at the first end. The receiving seal part e.g. the receiving groove may be shaped corresponding to the shape of the projecting seal part.

The projecting seal part, e.g. the protruding lip or rail, may extend along the entire skeleton or topological skeleton of the first end, preferably of the continuous circumferential side surface at the first end. The receiving seal part e.g. the receiving groove may be shaped corresponding to the shape of the projecting seal part.

The term 'skeleton' or 'topological skeleton' of a shape as used herein may mean a thin version or a line that is equidistant to the boundaries of the shape. The 'skeleton' or 'topological skeleton' may also be referred to as medial axis and is well known in the art of shape analysis and hence has not been described herein in further detail for sake of brevity.

The projecting seal part may further include at least one opposing protruding lip emanating outwardly from the circumferential side surface at the second end.

The receiving seal part may further include at least one opposing receiving groove recessed inwardly from the circumferential side surface at the first end, corresponding to the at least one opposing protruding lip of the projecting seal part.

In other words, the first end of one ring segment may include at least one projecting seal part and at least one receiving seal part, and the second end of adjacent ring segment may also include at least one projecting seal part and at least one receiving seal part. The at least one projecting seal part at the first end of the one ring segment and the at least one receiving seal part at the second end of the adjacent ring segment may correspond to each other. Similarly, the at least one projecting seal part at the second end of the adjacent ring segment and the at least one receiving seal part at the first end of the one ring segment may correspond to each other.

The at least one projecting seal part of the one ring segment and the at least one receiving seal part of the adjacent ring segment may correspond to each other. Similarly, the at least one projecting seal part of the adjacent ring segment and the at least one receiving seal part of the one ring segment may correspond to each other.

In the ring assembly, portions of at least two protruding lips of the one or more protruding lips may be parallelly disposed and spaced apart from each other.

Similarly, portions of at least two receiving grooves of the one or more receiving grooves may be parallelly disposed and spaced apart from each other, corresponding to the portions of the at least two protruding lips.

The one or more protruding lips may comprise at least one of a flat tip, a tapered tip, a rounded tip and a furcated tip. The one or more receiving grooves may or may not be correspondingly shaped.

At least one of the ring segments may include one or more fixing parts that extend radially outwardly from the outer surface of the ring segment for fixing the ring segment to a ring carrier of a stator of the gas turbine engine.

The projecting seal part and the receiving seal part may be formed to extend along a surface of the one or more fixing parts.

According to another embodiment of the present invention, a gas turbine is presented, wherein the gas turbine incorporates at least one ring assembly according to an embodiment of the present invention.

According to yet another embodiment of the present invention, a method of fabricating a ring assembly is presented, wherein the method is a method for fabricating a ring assembly according to an embodiment of the present invention. The method may include additively manufacturing at least one of the ring segments of the ring assembly.

In the additive manufacturing step, the projecting seal part and the receiving seal part of the ring segment may be manufactured together with the manufacturing of the remaining portion of the ring segment.

Alternatively, in the additive manufacturing step the projecting seal part may be manufactured together with the manufacturing of the remaining portion of the ring segment, except for the receiving seal part of the ring segment. The receiving seal part of the ring segment may be formed using another manufacturing technique such as machining.

Further alternatively, a part of the ring segment may be formed by any known manufacturing technique such as casting or additive manufacturing, and subsequently after the part has been formed, the projecting seal part may be manufactured by the additive manufacturing step to be an integral form. The receiving seal part of the ring segment may be formed using another manufacturing technique such as machining after or before performing of the additive manufacturing step.

BRIEF DESCRIPTION OF THE DRAWINGS

The above mentioned attributes and other features and advantages of the present invention and the manner of attaining them will become more apparent and the present invention itself will be better understood by reference to the following description of embodiments of the present invention taken in conjunction with the accompanying drawings, wherein.

Figure 1:
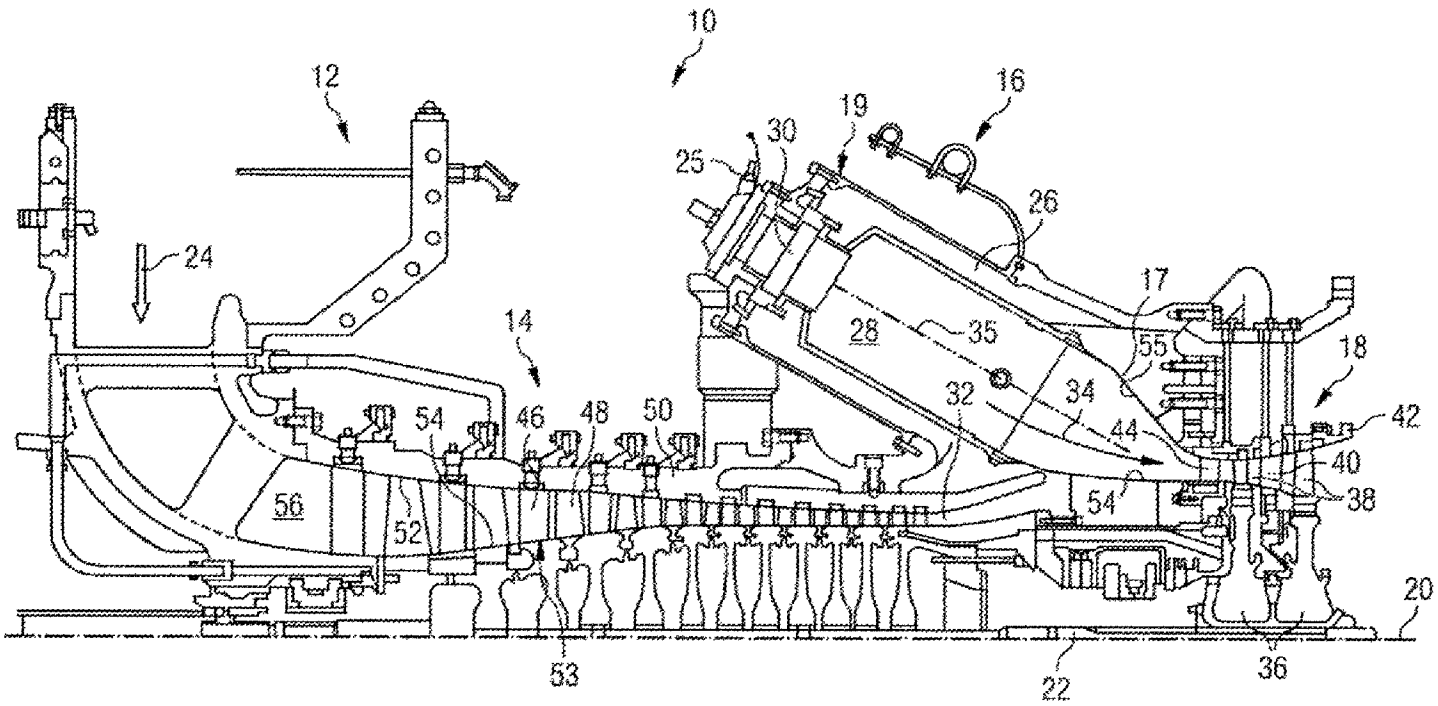
FIG. 1 shows a sectional view of a part of an exemplary embodiment of a gas turbine in which an exemplary embodiment of a ring assembly according to the present invention may be incorporated.

Hereinafter, above-mentioned and other features of the present invention are described in detail. Various embodiments are described with reference to the drawing, wherein like reference numerals are used to refer to like elements throughout the description. In the following description, for purpose of explanation, numerous specific details are set forth in order to provide a thorough understanding of one or more embodiments of the present invention. It may be noted that the illustrated embodiments and the terminology used herein are intended to explain, and not to limit the scope of the invention. The illustrated embodiments should be interpreted to include all modifications, equivalents, and alternatives of the embodiments included within the spirit and scope disclosed herein.

FIG. 1 shows an example of a gas turbine 10, also referred to as gas turbine engine 10, in a sectional view, which is explained further with exemplarily depictions of FIGS. 2-4A. The gas turbine 10 is an exemplary depiction of a gas turbine that may incorporate various embodiments of the present invention.

The gas turbine 10 may comprise an inlet 12, a compressor or compressor section 14, a combustion section 16 and a turbine section 18 which are generally arranged in flow series and generally about and in the direction of a rotational axis 20, also referred to a central axis 20 or a longitudinal axis 20. The gas turbine 10 may further comprise a shaft 22 which is rotatable about the rotational axis 20 and which extends longitudinally through the gas turbine 10. The shaft 22 may drivingly connect the turbine section 18 to the compressor section 14.

In operation of the gas turbine 10, air 24, which is taken in through the air inlet 12 is compressed by the compressor section 14 and delivered to the combustion section 16, also referred to as burner section 16. The combustion section 16 may comprise a burner plenum 26, one or more combustion chambers 28 and at least one burner 30 fixed to each combustion chamber 28. The compressed air passing through the compressor 14 may enter a diffuser 32 and may be discharged from the diffuser 32 into the burner plenum 26 from where a portion of the air may enter the burner 30 and is mixed with a gaseous or liquid fuel. The mixture of air and fuel is then burned and the combustion gas 34 from the combustion is channeled through the combustion chamber 28 to the turbine section 18 via a transition duct 17. The combustion gas 34 is also referred to as working gas, hot gas or combustion product.

This exemplary gas turbine 10 may have an arrangement of a cannular form of combustion section 16, which includes an annular array of combustor cans 19, each having the burner 30 and the combustion chamber 28. The transition duct 17 has a generally circular inlet that interfaces with the combustion chamber 28 and an outlet in the form of an annular segment. An annular array of the outlets of the transition duct 17 may form an annulus for channeling the combustion gases to the turbine section 18.

Figure 4A:
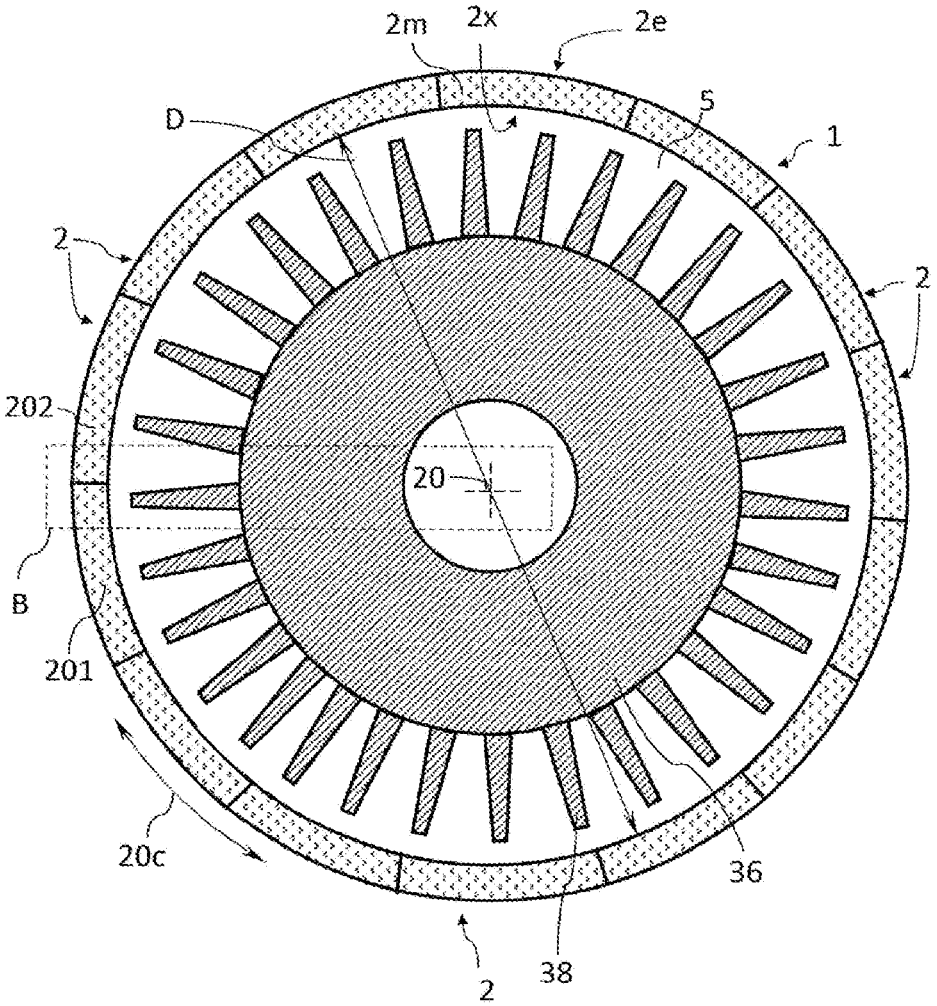
FIG. 4A schematically illustrates a schematic cross-sectional view of the ring assembly including the plurality of ring segments circumferentially arranged to form the ring assembly in which an embodiment of the present invention may be incorporated.
Figure 4B:
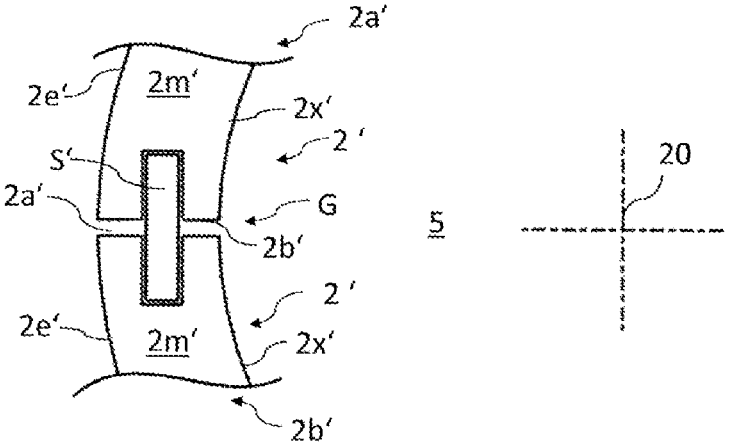
FIG. 4B (PRIOR ART)
FIG. 4B schematically illustrates a conventional sealing between two adjacent conventionally known ring segments.

The turbine section 18 may comprise a number of blade carrying discs 36 attached to the shaft 22. In an example according to FIG. 1, two discs 36, each carrying an annular array of turbine blades 38, are depicted. However, the number of blade-carrying discs could vary, for example, only one disc or more than two discs. FIG. 4A shows an exemplary depiction of a turbine section 18 having an array of turbine blades 38 circumferentially arranged on the disc 36. The array of turbine blades 38 may be referred to as a stage of turbine blades 38 or a turbine blade stage 38. In addition, guiding vanes 40, which are fixed to a stator 42 of the gas turbine 10, may be disposed between the stages of turbine blades 38. Between the exit of the combustion chamber 28 and the leading stage of turbine blades 38, inlet guiding vanes 44 may be provided which turn the flow of the combustion gas 34 onto the turbine blades 38.

The combustion gas 34 from the combustion chamber 28 enters the turbine section 18 and flows in a hot gas path 5. The combustion gas drives the turbine blades 38 which in turn rotate the shaft 22. The guiding vanes 40, 44 serve to optimize the angle of the combustion gas on the turbine blades 38.

The turbine section 18 drives the compressor section 14. The compressor section 14 may comprise an alternating series of vane stages 46 and rotor blade stages 48 in axial direction. The rotor blade stages 48 may comprise a rotor disc supporting an annular array of blades.

Figure 2A:
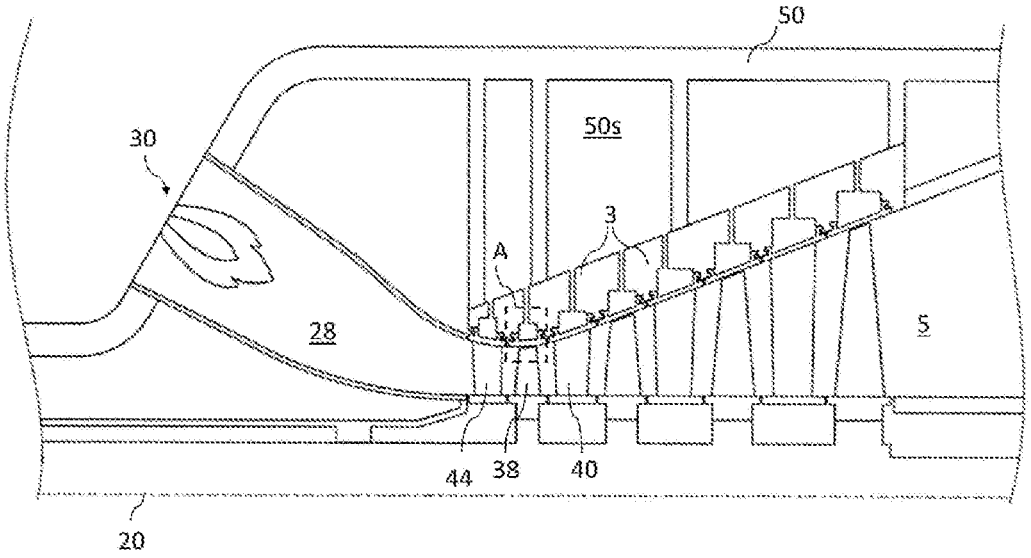
FIG. 2A schematically illustrates a position of a ring segment constituting the ring assembly in which an embodiment of the present invention may be incorporated.
Figure 3:
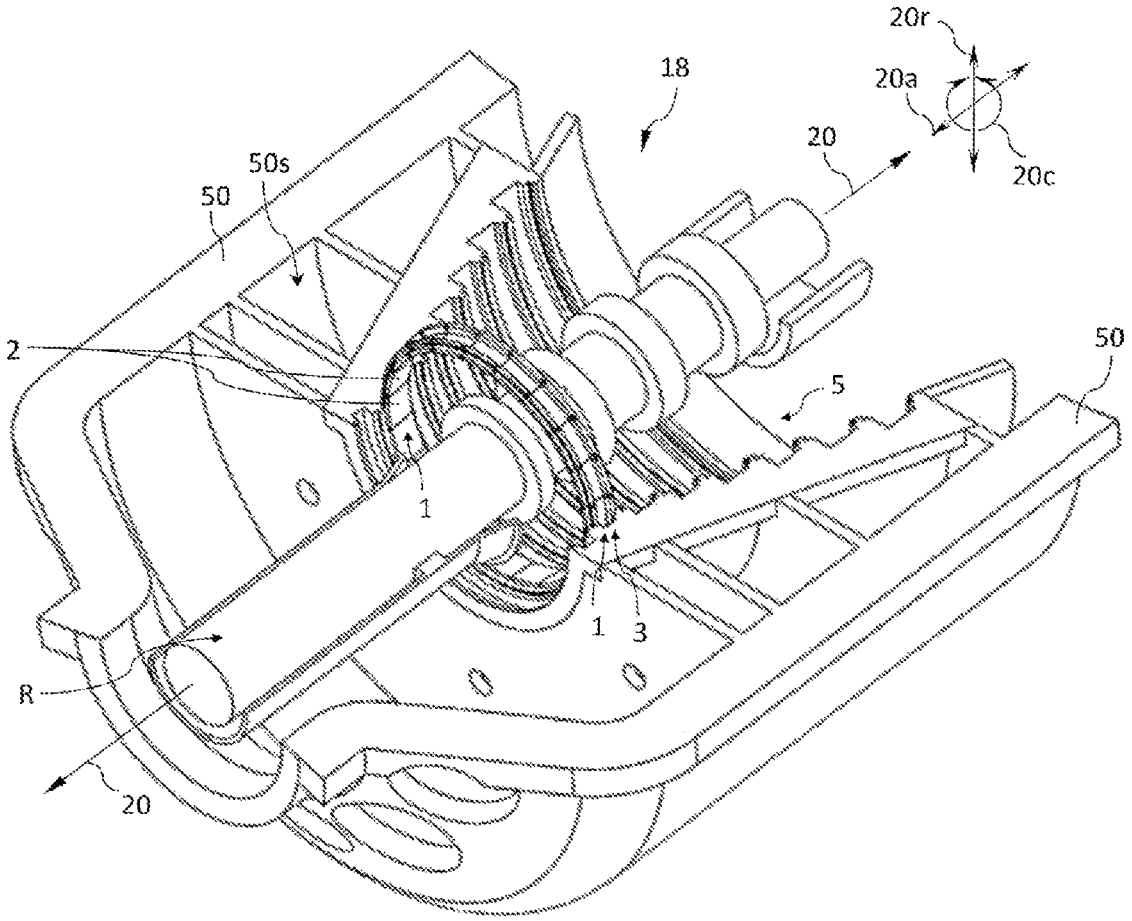
FIG. 3 schematically illustrates a perspective view of a ring assembly including a plurality of ring segments circumferentially arranged to form the ring assembly in which an embodiment of the present invention may be incorporated.

The gas turbine engine 10 may also comprise a casing 50 that surrounds the rotor R and supports stator stages such as stator 42. FIGS. 2A and 3 are exemplary depictions of such casing 50 of FIG. 1. The casing 50 may be an outer casing of the gas turbine engine.

As shown exemplarily in FIGS. 3 and 4A, the gas turbine engine 10 includes a ring assembly 1, also referred to as shroud or shroud ring or annular shroud or flow path ring, which is disposed circumferentially around the rotational axis 20 of gas turbine engine 10 and radially outwardly of the rotating turbine blades 38, which means spaced apart and facing the blade tips 38*a* of the turbine blades 38. It may be noted that the turbine blades 38 have not been depicted in FIG. 3 for sake of simplicity. It may be also noted that the arrangement of the ring assembly 1 is depicted in a schematic manner for sake of simplicity.

The ring assembly 1 is a stationary part. The ring assembly 1 may defines a part of the radially outer boundary of the hot gas flow path 5. The ring assembly 1 may confine the combustion gas 34 to the gas flow path 5 so that the combustion gas 34 is utilized with maximum efficiency to turn the rotor R of the gas turbine engine 10.

As shown in FIG. 3, the casing 50 may be disposed radially outwardly of the ring assembly 1. The ring assembly 1 may be housed in the casing 50 such that a space 50*s* is defined between the casing 50 and the ring assembly 1. Hereinafter, the space 50*s* may be also referred to as outer space 50*s*. The outer space 50*s* may generally be used for cooling air flow to supply cooling air, for example from the compressor section 14 (as shown in FIG. 1) of the gas turbine, to the ring assembly 1.

Embodiments of the present invention are described with reference to the above exemplary gas turbine, in which various embodiments of the present invention may be incorporated. The exemplary gas turbine may have a single shaft or spool connecting a single or multi-stage compressor to a single or multi-stage turbine. The gas turbine, in which various embodiments of the present invention may be incorporated, can be used for industrial, aero or marine applications.

The terms such as upstream and downstream, and also axially upstream and downstream, are used with reference to the flow direction of the airflow and/or working gas flow through the gas turbine engine, or generally with respect to a direction from the compressor section 14 towards the turbine section 18 unless otherwise stated. The terms axial, radial and circumferential are made with reference to the rotational axis 20 of the gas turbine 10. In other words, the terms 'axially', 'radially' and 'circumferentially', as used throughout the present description unless otherwise stated, are made with reference to axial direction 20*a*, radial direction 20*r* and circumferential direction 20*c*—with reference to the rotational axis 20 of the gas turbine 10—as shown in example of FIG. 3 and also in examples of other FIGS. where applicable. The terms such as axially 'inner', 'inwardly', and like terms may be understood as towards the rotational axis 20, and similarly terms such as axially 'outer', 'outwardly', and like terms may be understood as away from the rotational axis 20.

Hereinafter, the ring assembly 1 according to the present invention has been explained further with reference to exemplary depictions of FIGS. 3, 4A, 4C, and FIGS. 5B-12.

As exemplarily shown in FIG. 4A, the ring assembly 1 includes a plurality of stationary ring segments 2 (also referred to as shroud segments) that are assembled circumferentially, i.e. along the circumferential direction 20*c*, about the rotational axis 20 of the gas turbine engine 1 and radially outwardly, i.e. outwardly along the radial direction 20*r*, of the rotating turbine blades 38.

The ring segments 2 generally have accurate shape so that, when arranged circumferentially next to each other, the arrangement of the ring segments 2 may form the complete ring assembly 1 defining at least a part an outer boundary of the hot gas path 5.

It may be noted that the number of ring segments 2 depicted in FIG. 3 and in FIG. 4A are for exemplary purposes only, and the ring assembly 1 may comprise two or more ring segments 2, different from the number of the ring segments 2 depicted in FIG. 3 and in FIG. 4A.

Figure 4C:
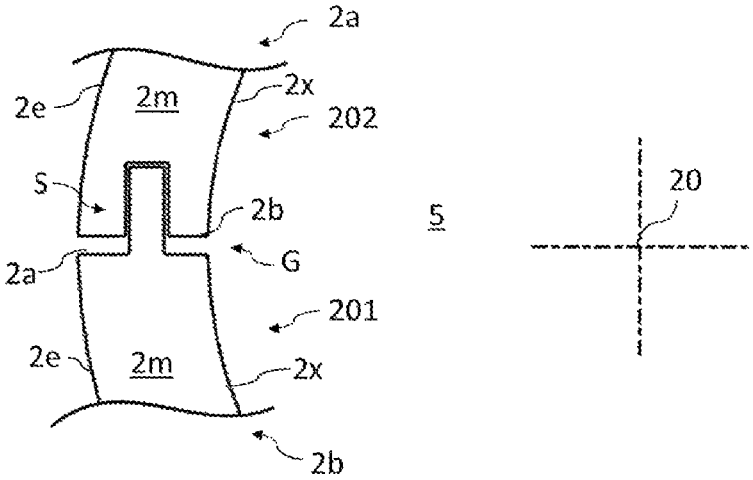
FIG. 4C shows portion B of FIG. 4A and schematically illustrates a sealing between two adjacent ring segments according to the present invention.
Figure 5A:
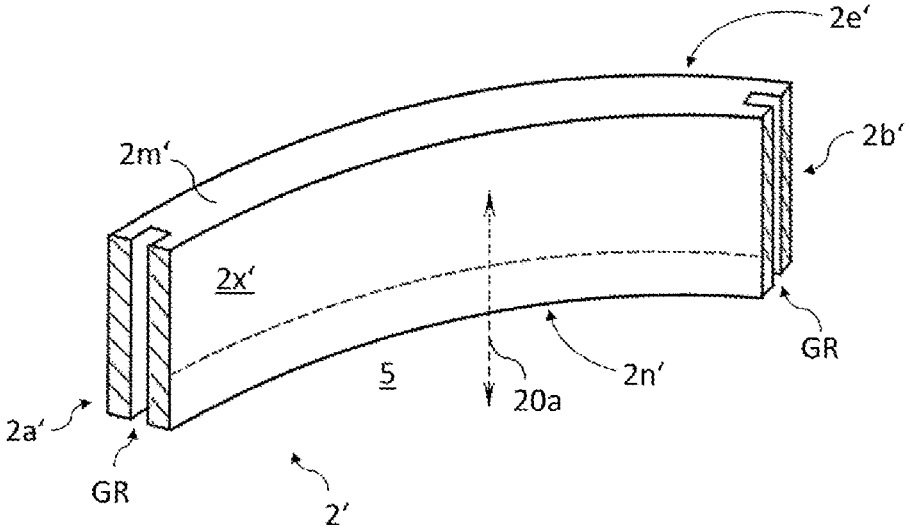
FIG. 5A (PRIOR ART)
FIG. 5A schematically illustrates an exemplary structure of the conventionally known ring segment shown in FIG. 4B.
Figure 5B:
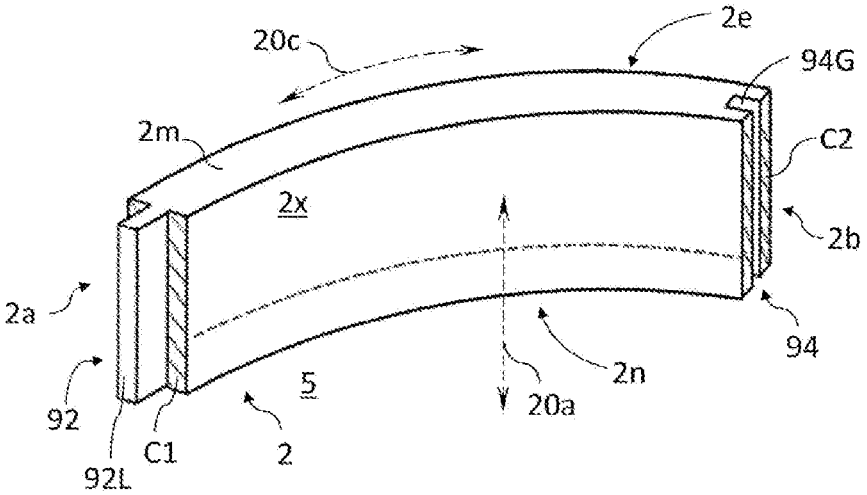
FIG. 5B schematically illustrates an exemplary embodiment of the ring segment shown in FIG. 4C according to the present invention, depicting a projecting sealing part at a first end of the ring segment and a receiving sealing part at a second end of the ring segment.

FIG. 4C schematically illustrates parts of two adjacently disposed ring segments 201, 202 according to an embodiment of the present invention. As exemplarily shown in FIGS. 4A and 4C, the ring segments 2 are circumferentially arranged with respect to the rotational axis 20 or central axis 20 of the gas turbine engine 10. FIG. 5B depicts an exemplary structure of the ring segments 2 according to an embodiment the present invention.

As exemplarily depicted in FIG. 5B, each of the ring segment 2 has a radially inner surface 2*x* facing radially inwardly and defining the hot gas path 5, a radially outer surface 2*e* radially spaced apart from the inner surface 2*x* and facing radially outwardly for example towards the casing 50, a first and a second axial surfaces 2*m*, 2*n* wherein 2*m* and 2*n* being spaced apart from each other in the axial direction 20*a* of the gas turbine, and a first circumferential side surface 2*a* and a second circumferential side surface 2*b*. The radially inner surface 2*x* may be referred to as inner surface 2*x* or gas surface 2*x*. The first circumferential side surface 2*a* may be referred to as first circumferential end 2*a* or the first end 2*a*. The second circumferential side surface 2*b* may be referred to as second circumferential end 2*b* or the second end 2*b*. The first end 2*a* and the second end 2*b* are spaced apart from each other along the circumferential direction 20*c*, with respect to the rotational axis 20 of the gas turbine engine 10.

To assemble the ring assembly 1, the first end 2*a* of one of the ring segments 2, e.g. the first ring segment 201 shown in FIGS. 4A and 4C, is arranged circumferentially adjacent to and/or facing the second end 2*b* of the second ring segment 202. The second ring segment 202 is another ring segment 2 that is disposed next to, or circumferentially adjacent to, the first ring segment 201.

In other words, in the ring assembly 1, the first ends 2*a* of each ring segment 201 is arranged facing the second end 2*b* of an adjacent ring segment 202.

The plurality of ring segments 2 after being assembled surround the blade array. In other words, the assembled ring segments 2 form the ring assembly 1 that surrounds or encircles the blade array.

Figure 2B:
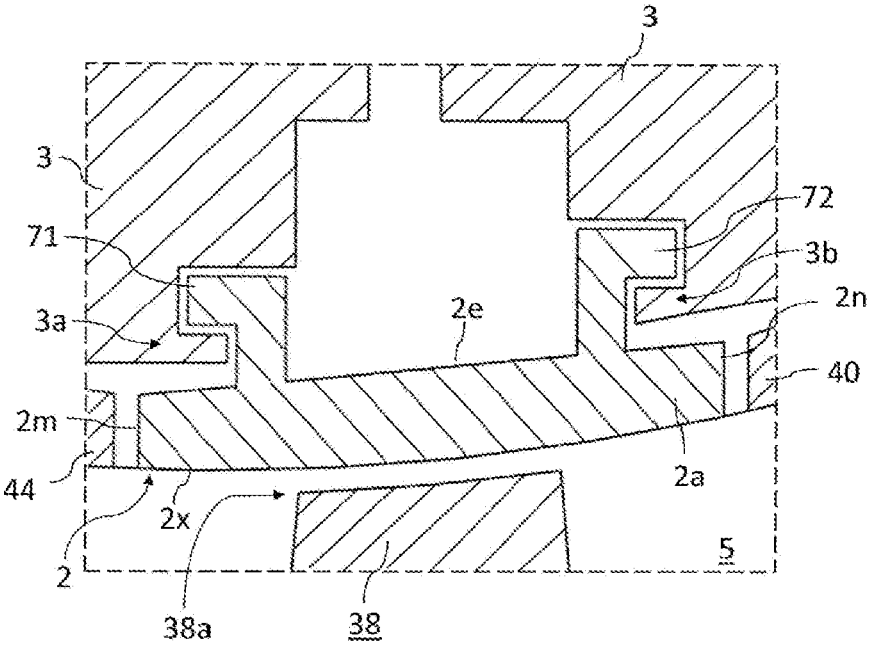
FIG. 2B schematically illustrates portion A of FIG. 2A.

It can be understood from FIG. 2B according to an embodiment of the present invention, the first and the second axial surfaces 2*m*, 2*n* of each ring segment 2 may be arranged facing stator vanes 44, 40, respectively. Also, as shown in FIG. 2B, two fixing parts 71, 72 such as fixing hooks may emanate from the outer surface 2*e* of each ring segment 2 and may be arranged in cooperation with a ring carrier 3 thereby getting fixed to a stator of the gas turbine engine 10, for example to the casing 50. The fixing parts 71, 72 may engage or be hooked with corresponding hooks 3*a*, 3*b* of the ring carrier 3.

As shown in FIG. 4C according to an embodiment of the present invention, junctions or gaps G between circumferentially arranged adjacent ring segments 2 of the ring assembly 1 are sealed by a seal or sealing arrangement S. The seal S prevents the cold secondary flow from leaking or entering into the hot gas path and prevents an uncontrolled gas streak from occurring, which lowers performance and might even harm the integrity of parts of the gas turbine engine 10, for example, parts surrounding the leakage.

The sealing arrangement S is a circumferential seal. The sealing arrangement S according to an embodiment of the present invention includes a projecting seal part 92 and a receiving seal part 94. The projecting seal part 92 and/or the receiving seal part 94 are formed integrally with the ring segment 2 in which the projecting seal part 92 and/or the receiving seal part 94 are included. In other words, the seal S together with the ring segment 2 builds an entity of the circumferential seal. The seal S itself is the connector between adjacent ring segments 2 and fixing mechanism of the faces of the adjacent ring segments 2. In other words, the seal S is the connector or fixing mechanism of adjacent ring segments 2 as well as the seal for the gap between the so connected adjacent ring segments 2. The adjacent ring segments 2 may thus be connected or fixed to each other only by the seal S. In other words, the adjacent ring segments 2 do not need to have any other connecting or fixing structures or sealing elements for connecting adjacent ring segments 2. FIG. 5B-7B schematically show various exemplary embodiments of the projecting seal part 92 and the receiving seal part 94.

The first end 2*a* of the first ring segment 201 includes the projecting seal part 92 formed integrally with the first ring segment 201, and the second end 2*b* of the second ring segment 202 includes the receiving seal part 94 formed integrally with the second ring segment 202.

The phrase 'formed integrally' or like terms, as used in the present disclosure, mean formed as one-part or one-piece or as one unit or as one structural entity or as one element or formed together or formed as one structural unit or as one continuous structural unit, or equivalents thereof. The phrase 'formed integrally' may also mean prefabricated before being assembled into the ring assembly 1. Because the projecting seal part 92 and the receiving seal part 94 are integrally formed, the sealing arrangement S may be referred to as or understood as integral seal S.

According to an embodiment, the projecting seal part 92 may be formed as one or more protruding lips 92L emanating outwardly from a circumferential side surface C1 at the first end 2*a*, and the receiving seal part 94 may be formed as one or more receiving grooves 94G recessed inwardly from a circumferential side surface C2 at the second end 2*b*, corresponding to the one or more protruding lips 92L of the projecting seal part 92.

A thickness of the projecting seal part 92 may be lesser than a thickness of the first end 2*a* of the ring segment 2 at which the projecting seal part 92 is formed. The thicknesses are measured along the radial direction 20*r*.

Furthermore, as shown in example of FIG. 5B according to an embodiment of the present invention, the projecting seal part 92, also referred to as the protruding lip 92 or rail 92, when the projecting seal part 92 is so formed, may be curved following or along or complying with the circumferential direction 20*c* along which the plurality of ring segments 2 are disposed. Similarly, the receiving seal part 94, also referred to as the receiving groove 94 or recess 94, when the receiving seal part 94 is so formed, may be curved following or along or complying with the circumferential direction 20*c* along which the plurality of ring segments 2 are disposed.

Figure 6A:
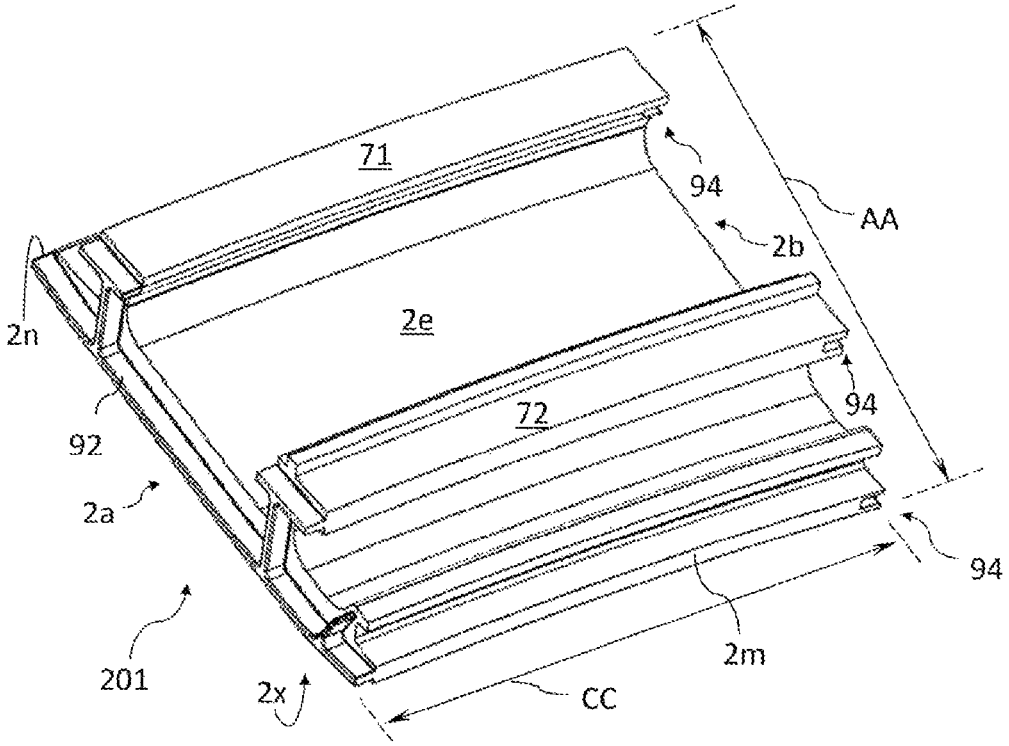
FIG. 6A illustrates a perspective view of another exemplary embodiment of the ring segment according to the present invention.
Figure 6B:
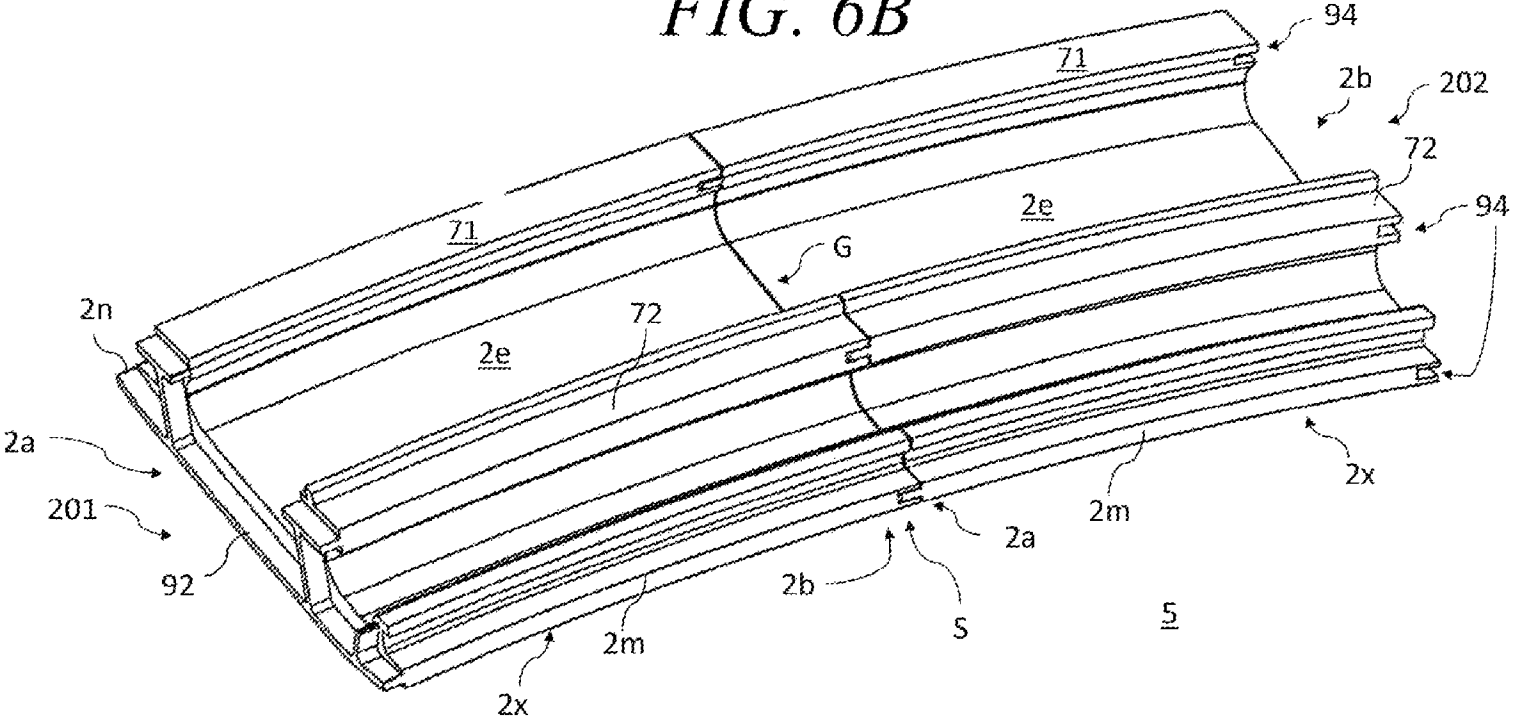
FIG. 6B illustrates a perspective view of an exemplary embodiment of the ring assembly in which two ring segments as shown in FIG. 6A according to the present invention are assembled with each other.
Figure 7A:
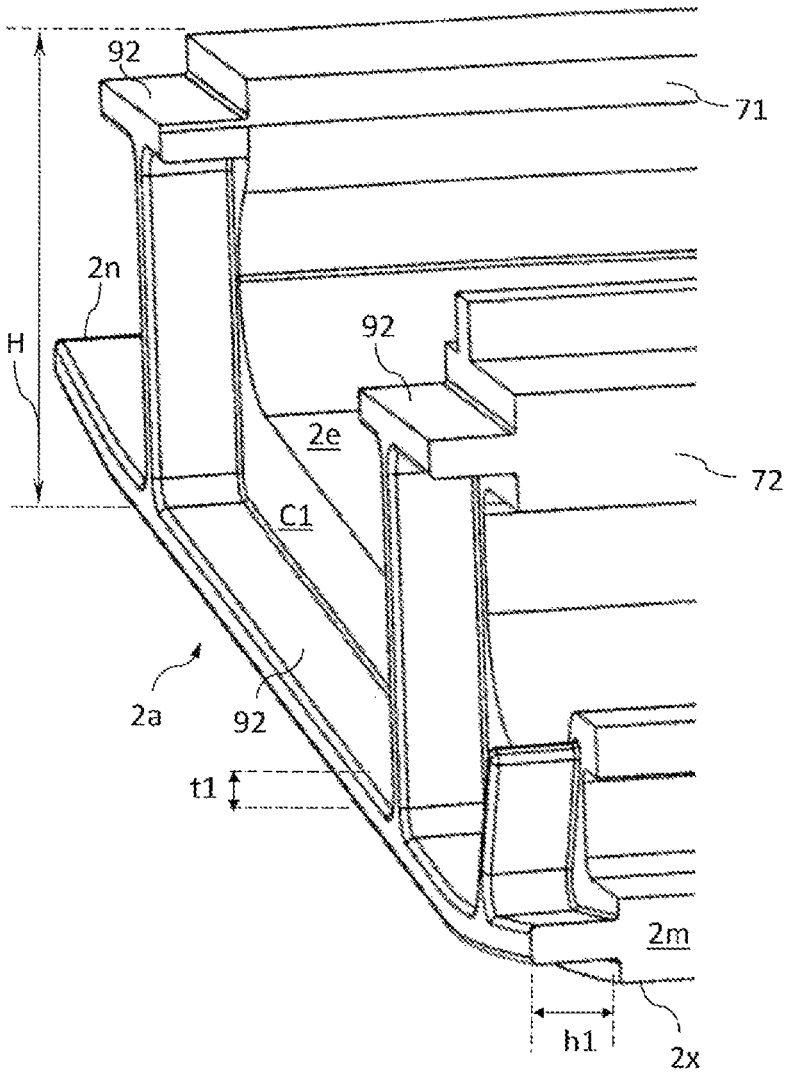
FIG. 7A illustrates a perspective view of an exemplary embodiment of the projecting sealing part at the first end of the ring segment of FIG. 6A.
Figure 7B:
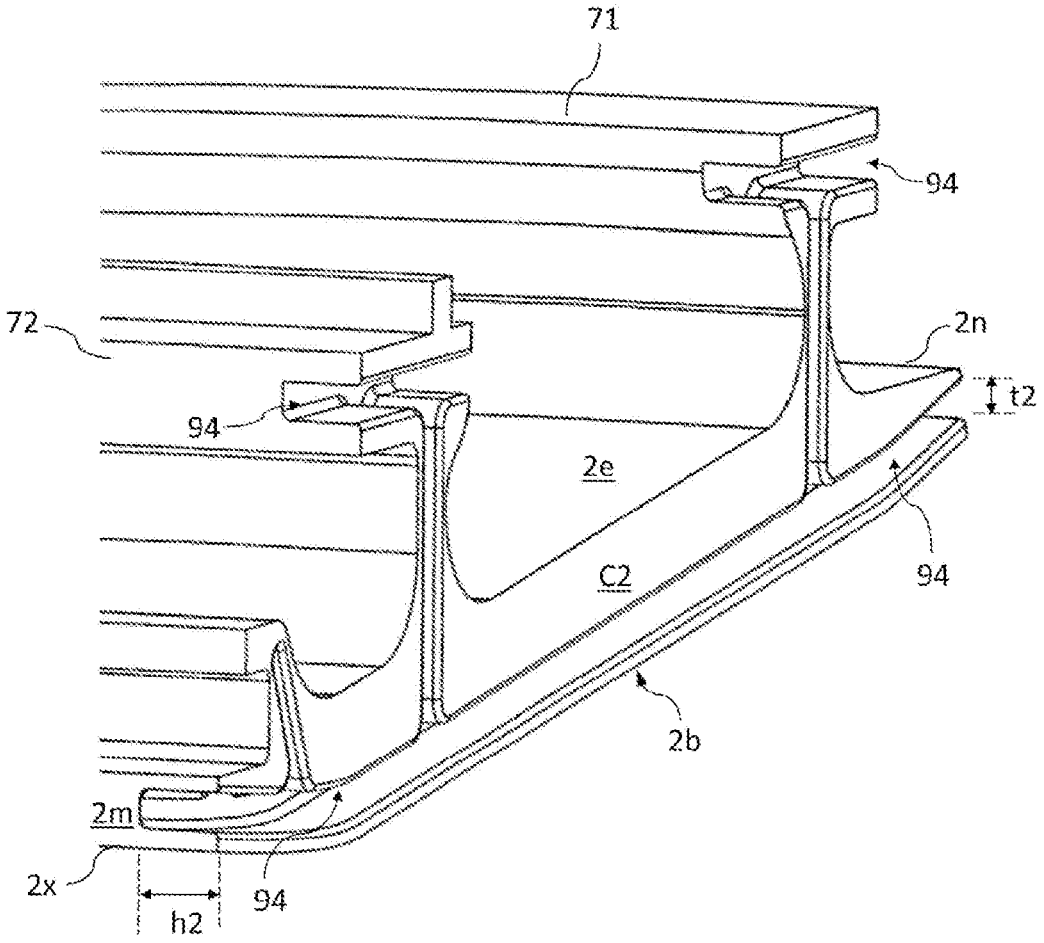
FIG. 7B illustrates a perspective view of an exemplary embodiment of the receiving sealing part at the second end of the ring segment of FIG. 6A.

The receiving seal part 94 of the second ring segment 202 receives the projecting seal part 92 of the first ring segment 201 to form a mating connection between the first ring segment 201 and the second ring segment 202, as shown in FIG. 6B in which the projecting seal part 92 of the first ring segment 201 as shown in FIG. 6A is assembled with or inserted into the receiving seal part 94 of the second ring segment 202. For example, the projecting seal part 92 may be insertable into the receiving seal part 94, such that the projecting seal part 92 is housed or seated within the receiving seal part 94 when inserted therein.

According to an embodiment, the projecting seal part 92 and the receiving seal part 94 may have mutually complementing shapes, however the present invention is not limited thereto.

According to an embodiment, the projecting seal part 92 when received into the receiving seal part 94 may have mutual surface-to-surface contact. However, according to an embodiment, there may also be an air gap between parts of the projecting seal part 92 and the receiving seal part 94. The projecting seal part 92 when received into the receiving seal part 94 may be, but not limited thereto, mutually friction fitted. In another embodiment, a shape and dimension of the projecting seal part 92 may be such that when the projecting seal part 92 is a received state into the receiving seal part 94, and the gas turbine engine 10 is operational, a pressure of the hot gas flowing through the hot gas path 5 may press the projecting seal part 92 towards the receiving seal part 94, for example may press the projecting seal part 92 towards a wall or surface defining the receiving seal part 94, in a radially outward direction, with respect to the rotational axis 20 of the gas turbine engine 10. As a result of the pressing, an air gap between the projecting seal part 92 and the receiving seal part 94 may be minimized and/or the projecting seal part 92 and the receiving seal part 94 may assume a state of mutual surface-to-surface contact.

Thus, as a result of the projecting seal part 92 of the first ring segment 201 being received into the receiving seal part 94 of the second ring segment 202, or as a result of the mating between the projecting seal part 92 of the first ring segment 201 and the receiving seal part 94 of the second ring segment 202, the sealing arrangement S is realized, and the junction or gap G between the first ring segment 201 and the second ring segment 202 is sealed. The sealing arrangement herein may mean an arrangement that at least partially obviates a pressure loss in the hot gas path, or, that at least partially obviates a leakage of hot gas form the hot gas path 5 to a space, such as the outer space 50*s*, radially outwardly across the junction or gap G between adjacently disposed ring segments 2.

The sealing function of the sealing arrangement S may be realized by mutual surface-to-surface contact between the projecting seal part 92 and the receiving seal part 94, when the projecting seal part 92 is in a received state into the receiving seal part 94 to help prevent leakage, and/or may be realized as a labyrinth seal, for example, by providing a tortuous path to help prevent leakage.

According to an embodiment, as depicted in FIG. 6B, in the ring assembly 1, the integrally formed projecting seal part 92 is formed or provided at the first end 2*a* of one ring segment 2, and the integrally formed receiving seal part 94 is formed or provided at the second end 2*b* of the adjacent ring segment 2. The projecting seal part 92 of the one ring segment 2 mates or engages with the receiving seal part 94 of the adjacent ring segment 2 to prevent leakage of hot gas from the hot gas path 5 to a radially outer-side of the hot gas path 5.

In an exemplary embodiment of the ring assembly 1 as depicted in FIG. 6B, the integrally formed projecting seal part 92 may be formed at the first end 2*a* of each of the ring segments 2; and the integrally formed receiving seal part 94 may be formed at the second end 2*b* of each of the ring segments 2. In other words, each of the ring segments 2 of the ring assembly 1 may be formed as exemplarily shown in FIG. 5B and FIG. 6A.

According to an exemplary embodiment, all of the ring segments 2 of the ring assembly may be identical to one another. However, in another exemplary embodiment of the ring assembly 1, the integrally formed projecting seal part 92 may be formed at the first end 2*a* of each of the ring segments 2 as exemplarily shown in FIG. 5B and FIG. 6A, except one of the ring segments 2—say a first exception ring segment (not shown). Similarly, the integrally formed receiving seal part 94 may be formed at the second end 2*b* of each of the ring segments 2 as exemplarily shown in FIGS. 5B and 6A, except one of the ring segments 2—say a second exception ring segment (not shown) which may be same as or different than the first exception ring segment.

For example, each of the ring segments 2 of the ring assembly 1 may be as exemplarily shown in FIGS. 5B and 6A, except one ring segment of the ring assembly 1 i.e. the exception ring segment. The exception ring segment may include grooves similar to receiving grooves 94G formed at its both first and second ends 2*a*, 2*b*, and may be used as a closure piece or closure segment or as a final ring segment 2 of the ring assembly 1, during the assembly process of the ring assembly 1.

The exception ring segment may be joined to an adjacently disposed ring segment 2 of the present invention by using a closing sealing element while the rest of the ring segments 2 are joined to its adjacently disposed ring segments by the sealing arrangement S. The closing sealing element may be formed as a closing sealing plate—one end of which is inserted into a groove at an end of the exception ring segment and the other end of which is inserted into the groove 94G at the second end 2*b* of the ring segment 2 adjacently disposed to the exception ring segment.

Hereinafter, with reference to FIGS. 5B to 5D, various exemplary embodiments of arrangements or structures or layout of the projecting seal part 92 and the receiving seal part 94 according to the present invention are explained.

Figure 5C:
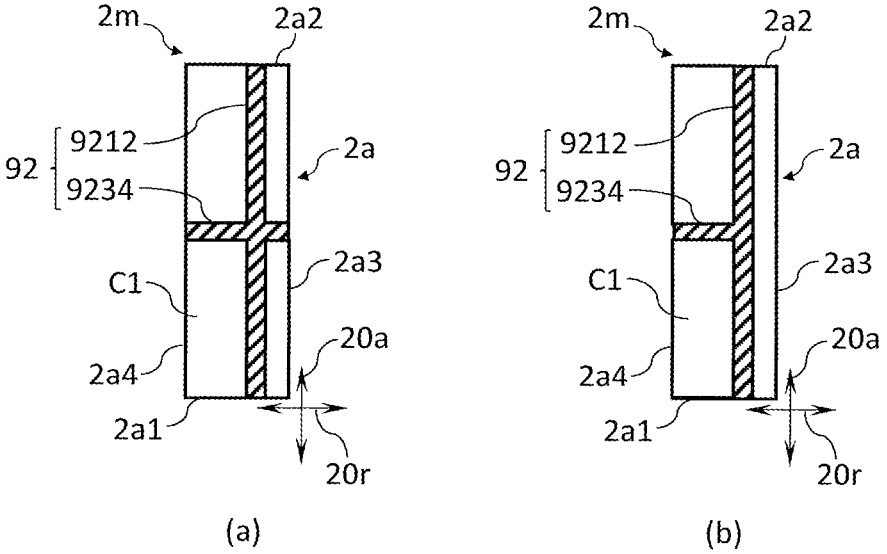
FIG. 5C schematically illustrates various exemplary embodiments of the projecting sealing part according the present invention.

According to an embodiment, as shown in FIG. 5C in combination with FIG. 5B, the first end 2*a* may have a first axial edge 2*a*1 and a second axial edge 2*a*2 which are axially spaced apart from each other i.e. along the axial direction 20*a*. The first end 2*a* may also have a radial edge 2*a*3 and a second radial edge 2*a*4 which are radially spaced apart from each other i.e. along the radial direction 20*r*.

The axial edges 2*a*1 and 2*a*2 may define the axial boundaries of the first end 2*a*. The radial edges 2*a*3 and 2*a*4 may define the radial boundaries of the first end 2*a*.

For example, the axial edges 2*a*1 and 2*a*2 may be edges or corners where the first end 2*a*, preferably a circumferential side surface C1 at the first end 2*a*, meets the axial surfaces 2*m*, 2*n* of the ring segment 2. Similarly, for example, the radial edges 2*a*3 and 2*a*4 may be edges or corners where the first end 2*a*, preferably the circumferential side surface C1 at the first end 2*a*, meets the radial surfaces 2*x*, 2*e* of the ring segment 2.

Simply put, the edges 2*a*1, 2*a*2, 2*a*3 and 2*a*4 may be edges or corners or periphery of the circumferential side surface C1 at the first end 2*a*, wherein the edges 2*a*1, 2*a*2, 2*a*3 and 2*a*4 of the first end 2*a* meet the axial surfaces 2*m*, 2*n* and the radial surfaces 2*x*, 2*e* of the ring segment 2.

According to an embodiment, the projecting seal part 92 may be formed as a protruding lip or rail and may include at least a first part 9212 which may be formed as a protruding lip or rail.

According to an embodiment, the projecting seal part 92 may be arranged to extend from the first axial edge 2*a*1 up to the second axial edge 2*a*2 of the first end 2*a*, as shown for example in FIG. 5B.

The first part 9212 of the projecting seal part 92 may be arranged to extend from the first axial edge 2*a*1 up to the second axial edge 2*a*2 of the first end 2*a*, as shown for example in FIG. 5C (a) and (b).

Figure 5D:
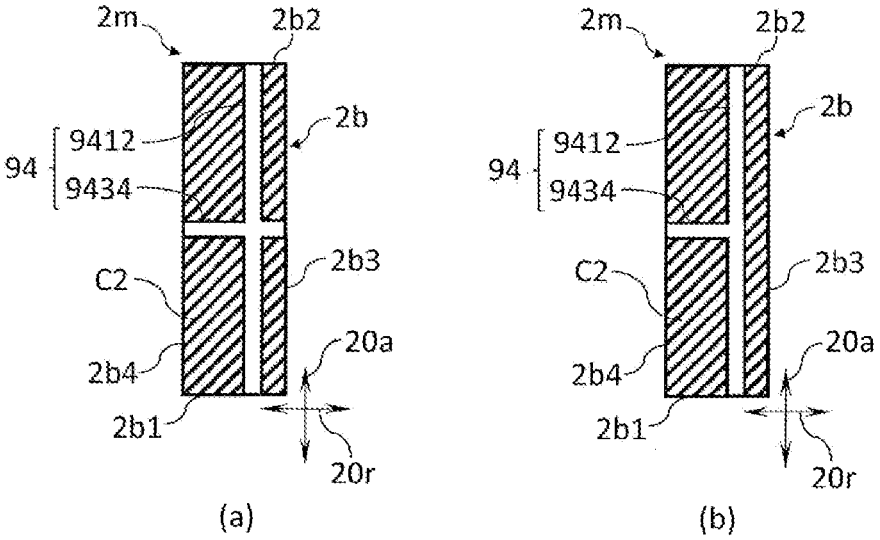
FIG. 5D schematically illustrates various exemplary embodiment of the receiving sealing part according to the present invention.

Similarly, as shown in FIG. 5D in combination with FIG. 5B, the second end 2*b* may have a first axial edge 2*b*1 and a second axial edge 2*b*2 which are axially spaced apart from each other i.e. along the axial direction 20*a*. The second end 2*b* may also have a first radial edge 2*b*3 and a second radial edge 2*b*4 which are radially spaced apart from each other i.e. along the radial direction 20*r*.

The axial edges 2*b*1 and 2*b*2 may define the axial boundaries of the second end 2*b*. The radial edges 2*b*3 and 2*b*4 may define the radial boundaries of the second end 2*b*.

For example, the axial edges 2*b*1 and 2*b*2 may be edges or corners where the second end 2*b*, preferably a circumferential side surface C2 at the second end 2*b*, meets the axial surfaces 2*m*, 2*n* of the ring segment 2. Similarly, for example, the radial edges 2*b*3 and 2*b*4 may be edges or corners where the second end 2*b*, preferably the circumferential side surface C2 at the second end 2*b*, meets the radial surfaces 2*x*, 2*e* of the ring segment 2.

Simply put, the edges 2*b*1, 2*b*2, 2*b*3 and 2*b*4 may be edges or corners or periphery of the circumferential side surface C2 at the second end 2*b*, wherein the edges 2*b*1, 2*b*2, 2*b*3 and 2*b*4 of the second end 2*b* meet the axial surfaces 2*m*, 2*n* and the radial surfaces 2*x*, 2*e* of the ring segment 2.

The receiving seal part 94 may be formed as a receiving groove (or recess or notch) and may include at least a first part 9412 which may be formed as a receiving groove (or recess or notch).

The receiving seal part 94 may be arranged to extend from the first axial edge 2*b*1 up to the second axial edge 2*b*2 of the second end 2*b*, as shown for example in FIG. 5B.

The first part 9412 of the receiving seal part 94 may be arranged to extend from the first axial edge 2*b*1 up to the second axial edge 2*b*2 of the receiving end 2*b*, as shown for example in FIG. 5D (a) and (b).

According to an embodiment of the present invention, as shown in FIG. 5C, the projecting seal part 92 may include a second part 9234 that extends towards the first radial edge 2*a*3 and/or towards the second radial edge 2*a*4 of the first end 2*a*.

Similarly, as shown in FIG. 5D, the receiving seal part 94 may include a second part 9434 which may extend towards the first radial edge 2*b*3 and/or towards the second radial edge 2*b*4 of the second end 2*a*.

The first part 9212 and the second part 9234 of the projecting seal part 92 may intersect each other as shown in example of FIG. 5C (a) or may join each other as shown in example of FIG. 5C (b).

Similarly, the first part 9412 and the second part 9434 of the receiving seal part 94 may intersect each other as shown in example of FIG. 5D (a) or may join each other as shown in example of FIG. 5D (b).

It may be noted that, the depictions of FIGS. 5C and 5D may be understood as representing the first end 2*a* and the second end 2*b* of the same ring segment 2, as shown in FIG. 5B. However, the depictions of FIGS. 5C and 5D may also be understood as representing the first end 2*a* of one ring segment 2 and the second end 2*b* of another ring segment 2 that is disposed adjacent to the one ring segment 2, wherein the first end 2*a* shown in FIG. 5C faces the second end 2*b* shown in FIG. 5D.

Hereinafter, with reference to FIGS. 8A-8D and FIGS. 9A-9D, other various exemplary embodiments according to the present invention are explained.

Figure 8A:
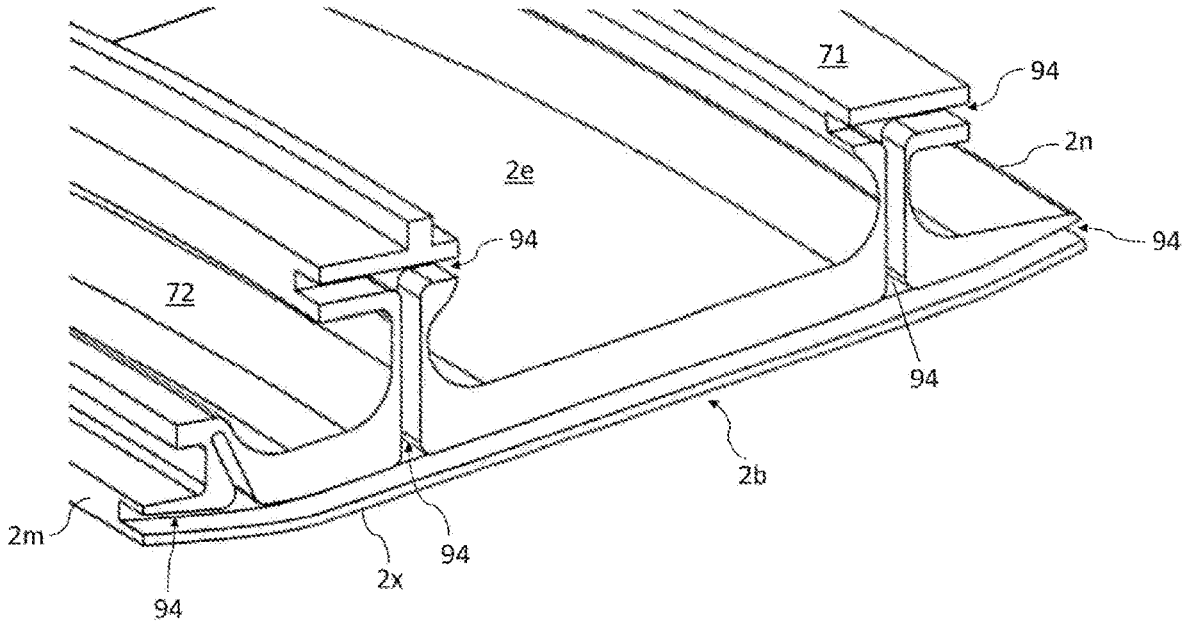
FIG. 8A-D illustrate different views of an exemplary embodiment of the ring segment and of the ring assembly formed by the ring segment, according to the present invention.
Figure 8B:
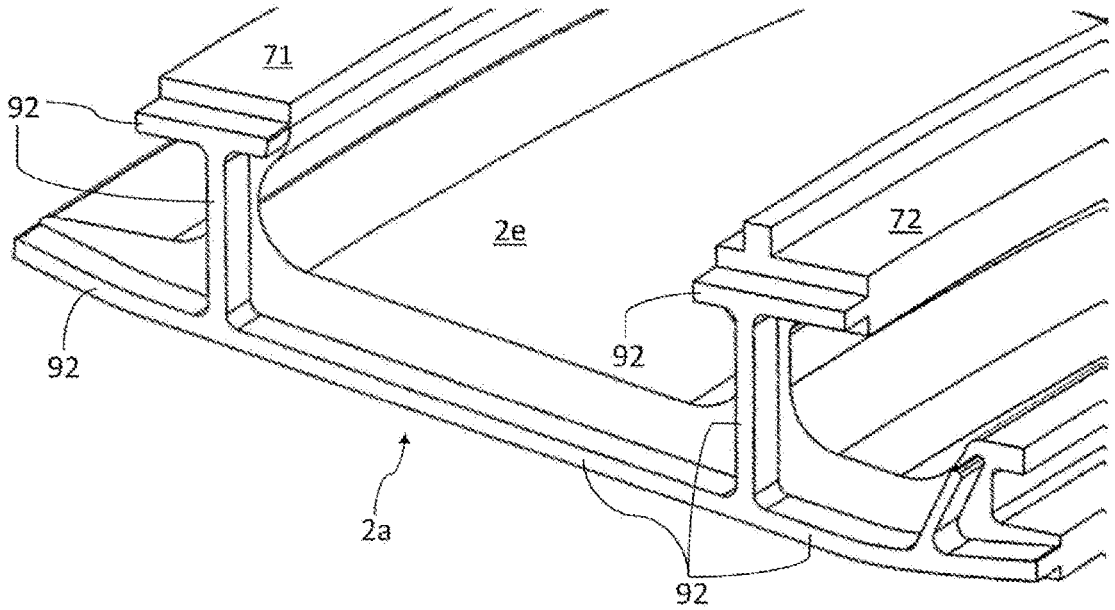
Figure 8C:
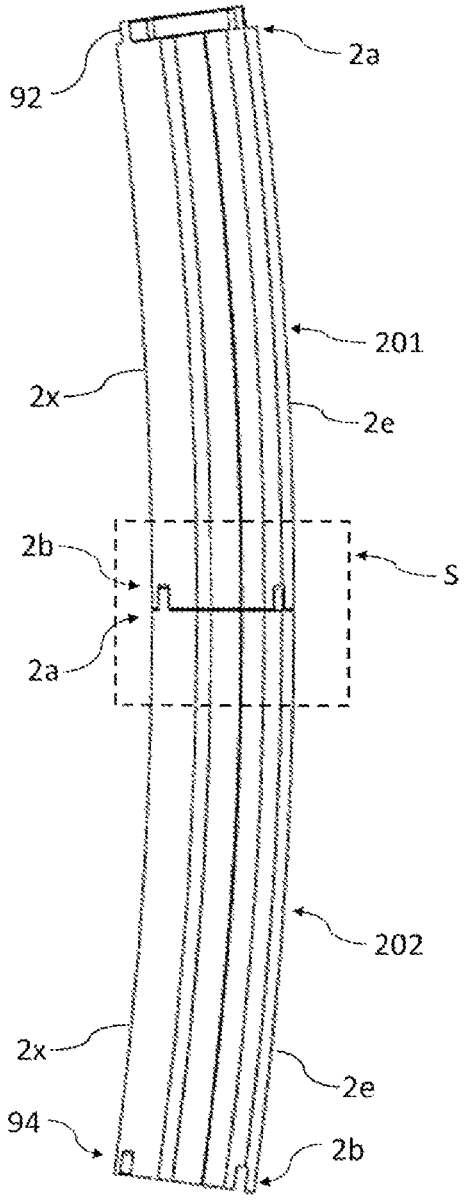
Figure 8D:
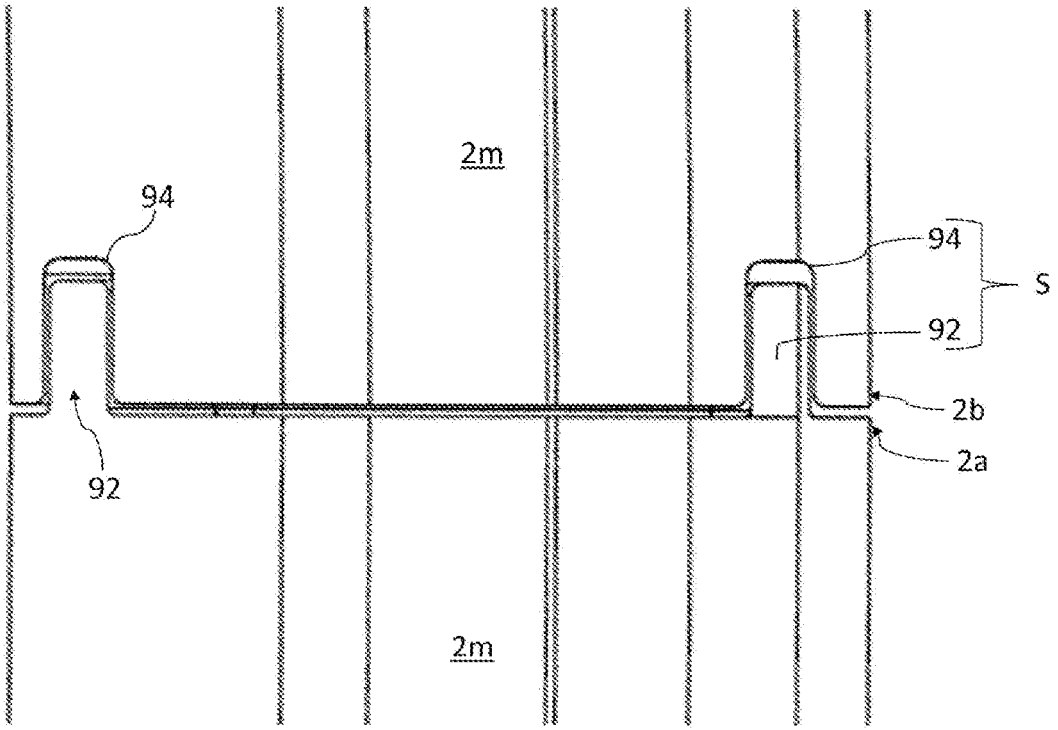

FIGS. 8A and 8B illustrate a perspective view of the ring segment 2 according to an embodiment of the present invention. FIG. 8A depicts the second circumferential end 2*b*, and FIG. 8B illustrates a perspective view of the first circumferential end 2*a* of the same ring segment and/or of another adjacent disposed ring segment. FIG. 8C illustrates a cross-sectional view of the ring assembly 1 in which two ring segments 201, 202 having a structure as shown in FIGS. 8A and 8B are assembled with each other. FIG. 8D illustrates a magnified view of the seal arrangement S of FIG. 8C.

Figure 9A:
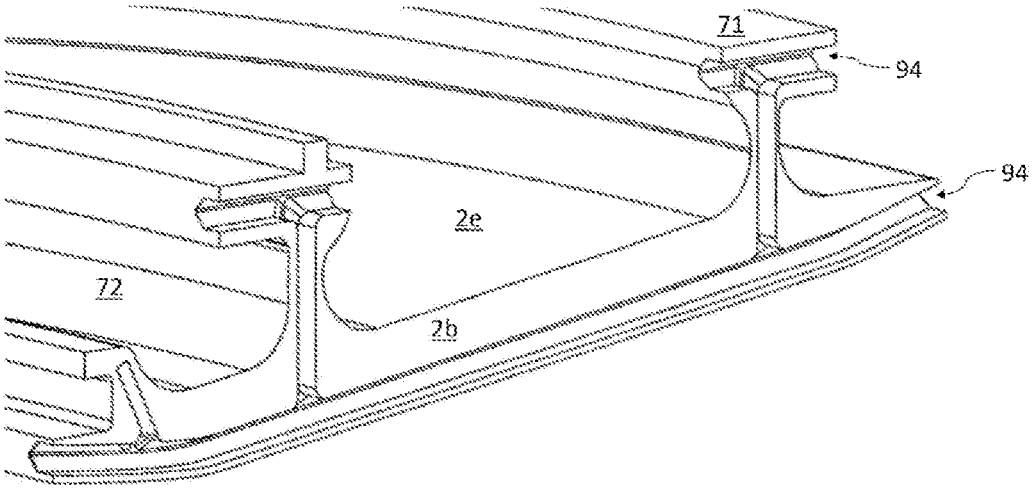
FIG. 9A-D illustrate different views of another exemplary embodiment of the ring segment and of the ring assembly formed by the ring segment, according to the present invention.
Figure 9B:
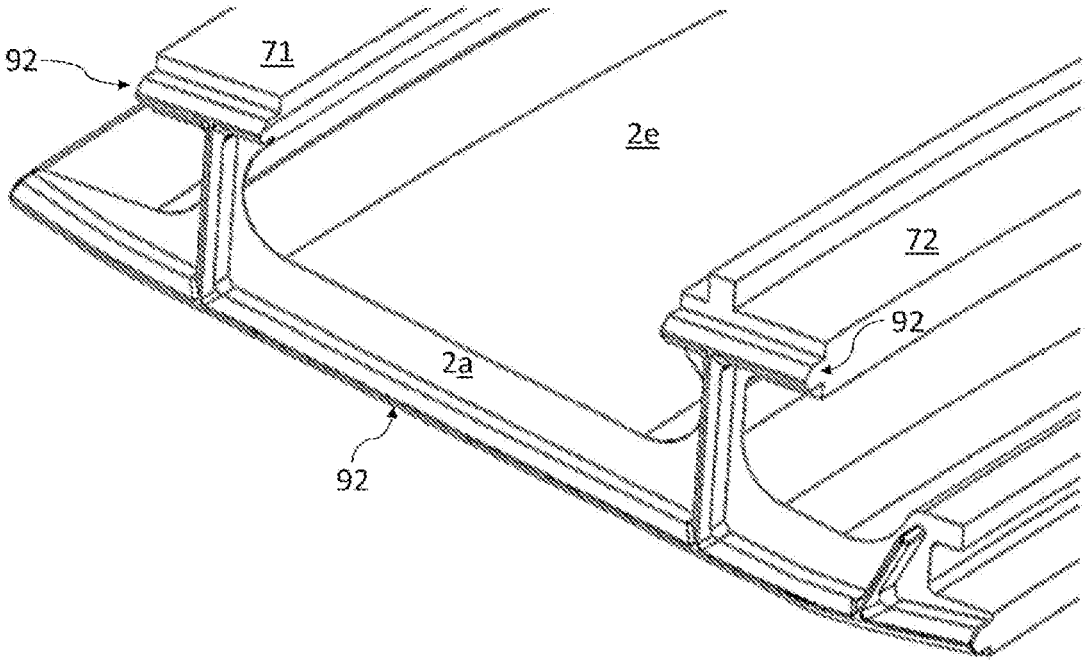
Figure 9C:
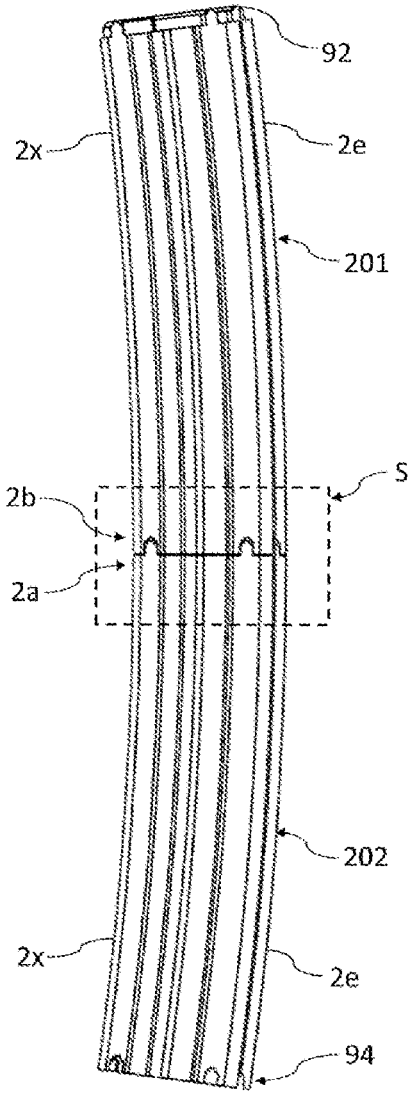
Figure 9D:
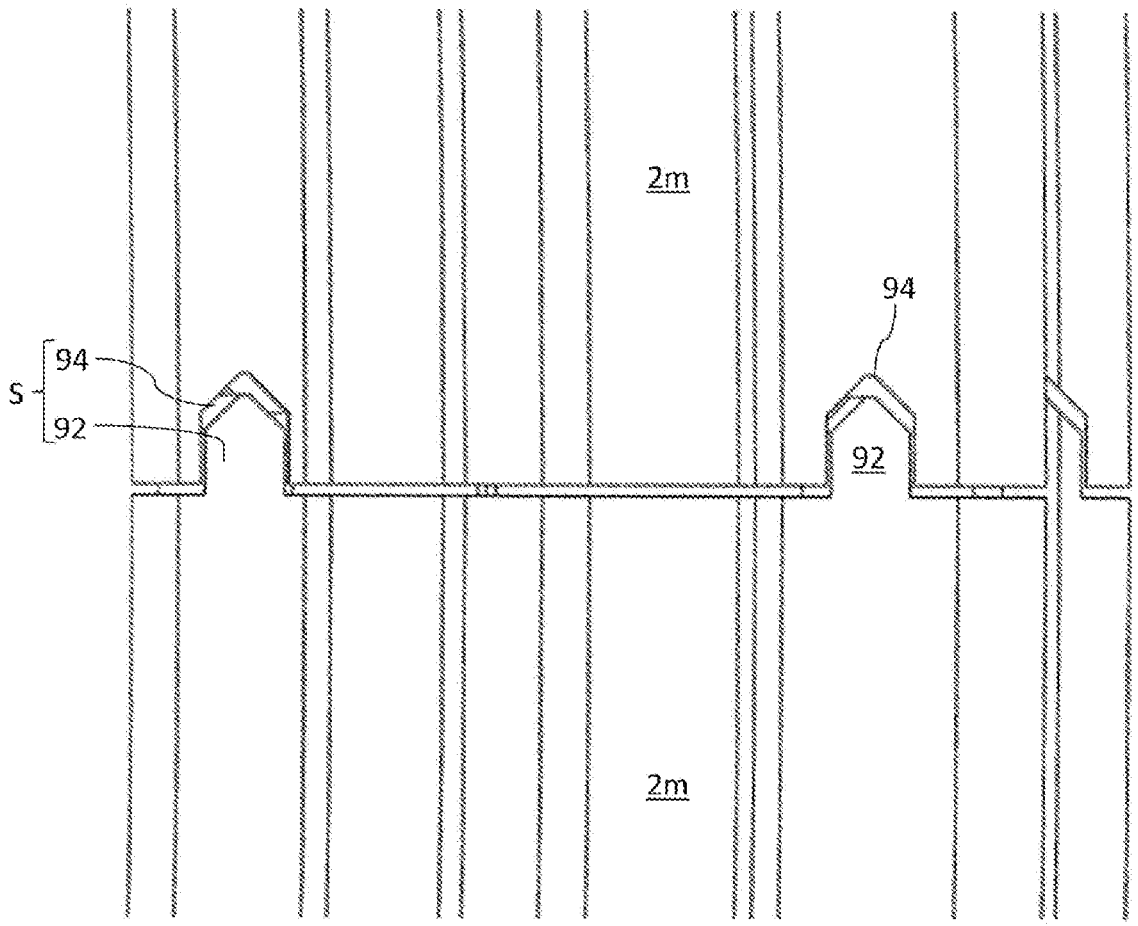

Similarly, FIGS. 9A and 9B illustrate a perspective view of the ring segment 2 according to another embodiment of the present invention. FIG. 9A depicts the second circumferential end 2*b*, and FIG. 9B illustrates a perspective view of the first circumferential end 2*a* of the same ring segment and/or of another adjacent disposed ring segment. FIG. 9C illustrates a cross-sectional view of the ring assembly 1 in which two ring segments 201, 202 having a structure as shown in FIGS. 9A and 9B are assembled with each other. FIG. 9D illustrates a magnified view of the seal arrangement S of FIG. 9C.

Referring to FIGS. 8A-9D, and as previously mentioned, the projecting seal part 92 may be realized as a protruding lip or rail. The projecting seal part 92 may have a structure corresponding to a contour of the first end 2*a* or of the topological skeleton of the first end 2*a*. In other words, the projecting seal part 92 may have an outline or shape or layout or structure that corresponds to the topological skeleton or a contour of the circumferential side surface C1 at the first end 2*a*.

The protruding lip or rail 92 may be branched to conform to the outline or form of the first end 2*a*, preferably of the circumferential side surface C1 at the first end 2*a*.

Similarly, as previously mentioned, the receiving seal part 94 may be realized as a receiving groove or recess. The receiving groove 94 may have a structure corresponding to the projecting seal part 92 and optionally may also correspond to a contour of the second end 2*b* or of the topological skeleton of the second end 2*b*. In other words, the receiving groove 94 may have an outline or shape or layout or structure that corresponds to a topological skeleton or a contour of the circumferential side surface C2 at the second end 2*b*.

The receiving seal part or groove 94 may be branched to conform to the outline or form of the projecting seal part 92.

The circumferential side surfaces C1 and C2 may include the planar surface between the radially outer 2*e* and the inner surface 2*x* of the ring segment 2, and may optionally also include circumferential side surfaces of the one or more fixing parts 71, 72 when the circumferential side surfaces of the one or more fixing parts 71, 72 may be formed to be flush with the planar surface between the radially outer and the inner surface 2*e* and 2*x*.

Thus, more effective sealing of the junction or gap G may be realized.

Hereinafter, with reference to FIGS. 10A-10D and FIG. 11A, yet another various exemplary embodiments of the present invention are explained.

Figure 10A:
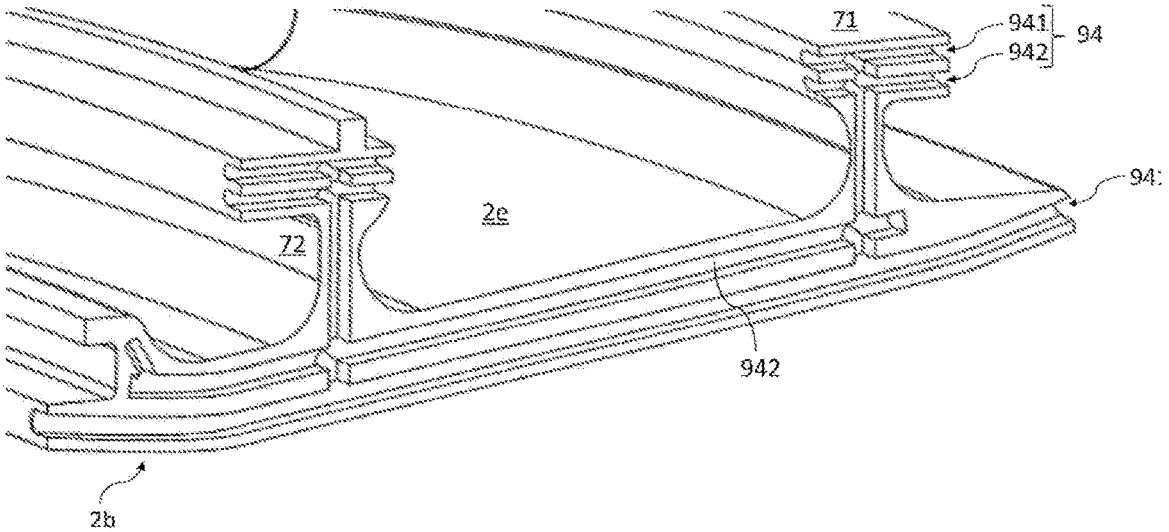
FIG. 10A-D illustrate different views of yet another exemplary embodiment of the ring segment and of the ring assembly formed by the ring segment, according to the present invention.
Figure 10B:
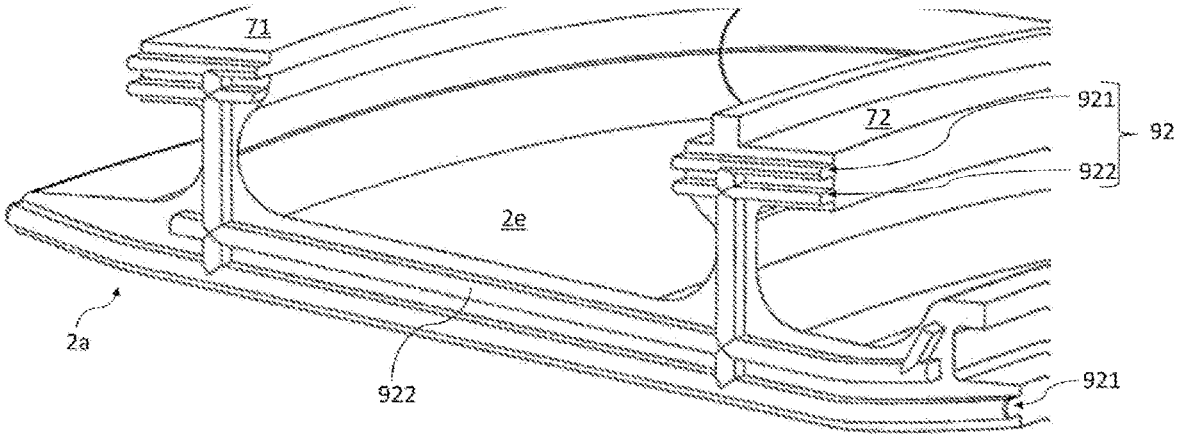
Figure 10C:
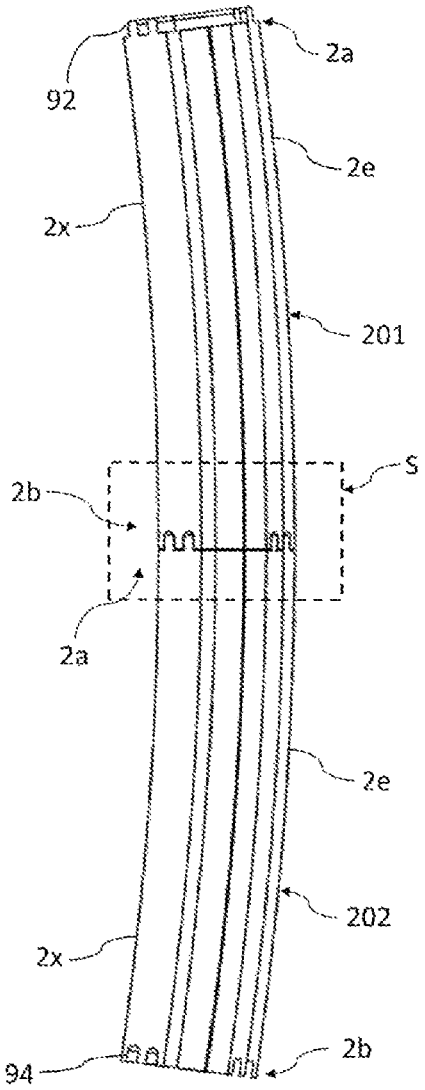
Figure 10D:
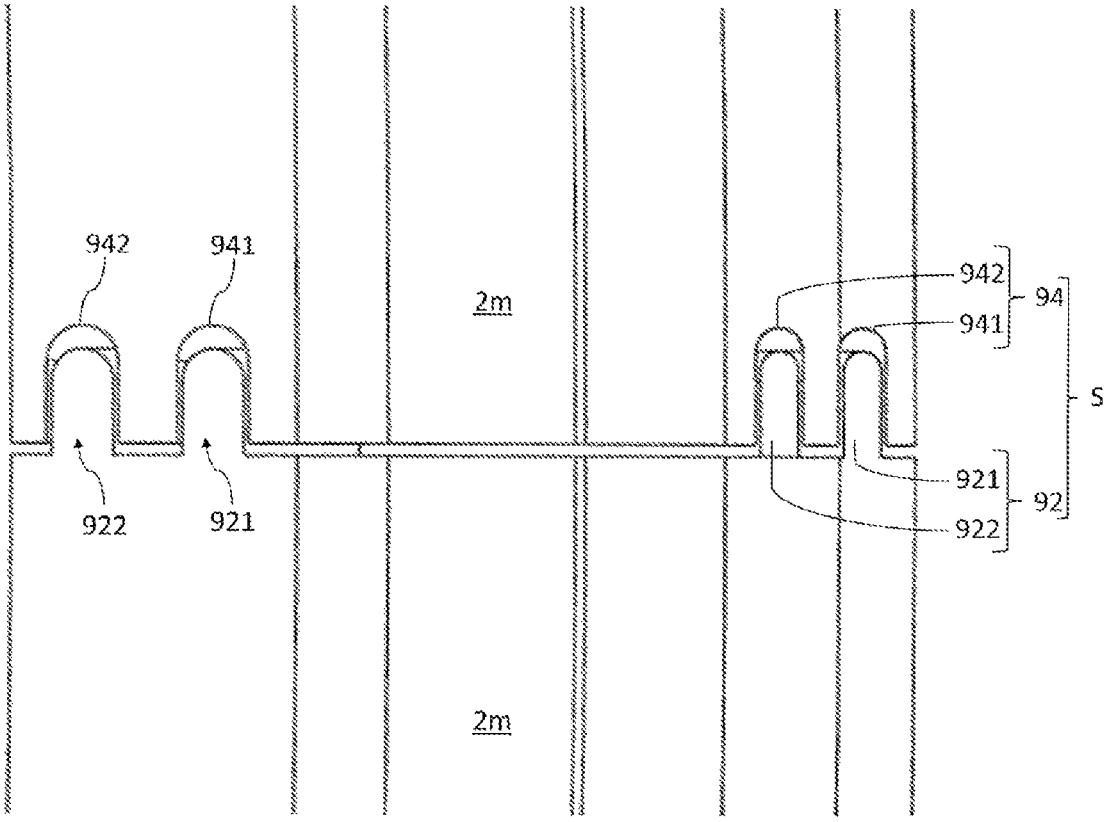

FIG. 10A illustrates a perspective view of the ring segment 2 according to an embodiment of the present invention. FIG. 10A depicts the second circumferential end 2*b*, and FIG. 10B illustrates a perspective view of the first circumferential end 2*a* of the same ring segment and/or of another adjacent disposed ring segment. FIG. 10C illustrates a cross-sectional view of the ring assembly 1 in which two ring segments 201, 202 having a structure as shown in FIGS. 10A and 10B are assembled with each other. FIG. 10D illustrates a magnified view of the seal arrangement S of FIG. 10C.

Different from the embodiment according to FIGS. 8A-9D, the embodiment of FIGS. 10A-10D, has a multi-rail or multi-lip structure. In short, the rail 92 of FIGS. 8A-9D is disposed next to another similar rail 92, and the two rails or protruding lips are offset by a predetermined distance.

In other words, the projecting seal part 92 includes a plurality of protruding lips 921, 922 which are collaterally arranged. Similarly, the receiving seal part 94 includes a plurality of corresponding receiving grooves 941, 942.

Description of each of the protruding lips or rails 921, 922 and of each of the receiving grooves 941, 942 may be similar as of the protruding lip or rail 92 and of the receiving groove 94, respectively, as described hereinabove with reference to FIGS. 8A-9D, and therefore the same are not described in detail herein again for the sake of brevity.

The embodiment having multi-rail or multi-lip structure 921, 922 with corresponding receiving grooves 941, 942 may be advantageous in obtaining a further torturous labyrinth seal structure or by introducing a supplementary in the sealing structure.

Figure 11A:
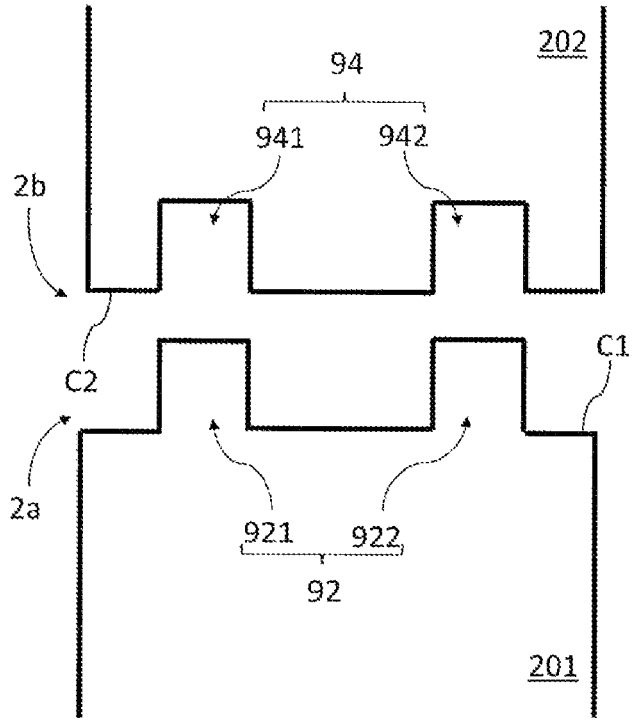
FIG. 11A,B schematically illustrate different exemplary embodiments of the projecting sealing part and the receiving sealing part, according to the present invention.
Figure 11B:
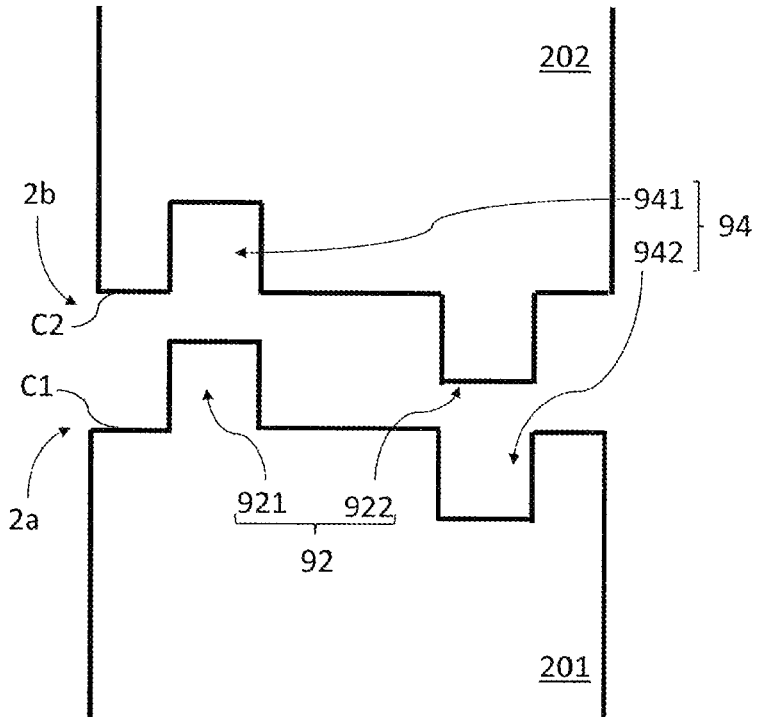

The aforementioned sealing structure may also be realized in another embodiment as shown in FIG. 11B, different from the previously described arrangement of FIGS. 10-11A.

As shown in FIG. 11B, the projecting seal part 92 may include one or more protruding lips or rails 921 at the first end 2*a* and one or more receiving groove 941 at the second end 2*a*, similar to as described with reference to FIGS. 8A-10D, and at the same time may further include at least one opposing protruding lip 922 at the second end 2*b* facing the first end 2*a*, and a corresponding at least one opposing receiving groove 942 at the first end 2*a* facing the second end 2*b*.

The opposing protruding lip 922 may also be integrally formed and may emanate or protrude outwardly from the circumferential side surface C2 at the second end 2*b*.

Similarly, the opposing receiving groove 942 may also be integrally formed and recessed inwardly from the circumferential side surface C1 at the first end 2*a*.

According to an embodiment, the multi-rail or multi-lip structure 921, 922 with corresponding receiving grooves 941, 942 as described by examples of FIGS. 11A and 11B, may be realized by having portions of at least two protruding lips 921, 922 to be parallelly disposed and spaced apart from each other; and by having corresponding portions of at least two receiving grooves to be parallelly disposed and spaced apart from each other.

Hereinafter, with reference to FIG. 12, various exemplary embodiments of different shapes of the protruding lips or rails 92 and of the corresponding receiving grooves 94 according to the present invention are explained.

Figure 12:
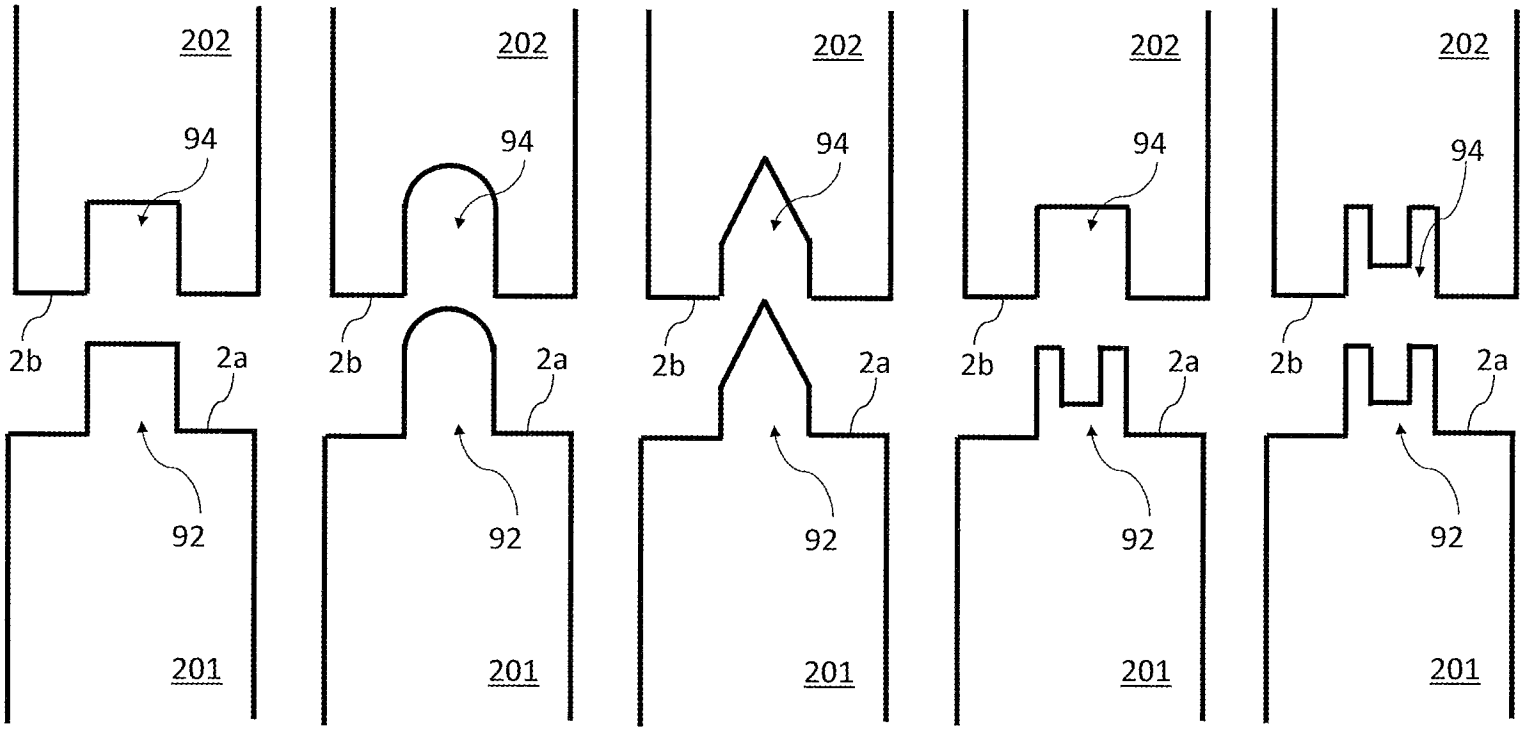
FIG. 12 schematically illustrate different exemplary embodiments depicting different shapes of the projecting sealing part and the receiving sealing part, according to the present invention.

As shown in FIG. 12(*a*), one or more of the protruding lips 92 may have flat tip. The receiving grooves 94 may be complementarily or similarly shaped.

As shown in FIG. 12(*b*), one or more of the protruding lips 92 may have rounded tip. The receiving grooves 94 may be complementarily or similarly shaped.

As shown in FIG. 12(*c*), one or more of the protruding lips 92 may have tapered tip. The receiving grooves 94 may be complementarily or similarly shaped.

As shown in FIGS. 12(*d*) and (*e*), one or more of the protruding lips 92 may have furcated or branched tip. The receiving grooves 94 may be complementarily or similarly shaped as shown in FIG. 12(*e*), or may be slightly differently or non-complementarily shaped while being generally shaped so as to receive or mate with or engage with the protruding lips 92 as shown in FIG. 12(*d*). The embodiment of FIG. 12(*e*) increases the turns in seal arrangement thereby obtaining a further torturous labyrinth seal structure. The embodiment of FIG. 12(*d*) forms a pocket or gap, which may get filled with cooling air or hot gas, and obstructs the flow across the seal arrangement S.

As shown in FIG. 2B and FIGS. 6A-10D, in the ring assembly 1 at least one of the ring segments 2 may include one or more fixing parts 71, 72 which extend radially outwardly from the outer surface 2*e* of the ring segment 2 for fixing the ring segment 2 to the ring carrier 3 of a stator of the gas turbine engine 10. According to an embodiment, the projecting seal part 92 and the receiving seal part 94 may be formed to extend along a surface of the one or more fixing parts 71, 72. It may be noted that in FIG. 2B does not depict parts of the projecting seal part 92 or the receiving seal part 94 for sake of simplicity.

According to an embodiment of the present invention, the ring segment 2 may have a rectangular or square profile having a size, CC to AA (shown in FIG. 6A), of 150-200 mm (millimetre) (distance between the first and the second end 2*a*, 2*b*) to 150-200 mm (distance between the axial sides 2*m*, 2*n*) and a height H (shown in FIG. 7A) of 30-60 mm (measured along the radial direction including the fixing parts 71, 72).

According to an embodiment, the integrated projecting seal part 92, i.e. the protruding lip 92, may be approximately 5-10 mm high, i.e. protruding length h1 (shown in FIG. 7A), from the surface C1. The receiving seal part 94, i.e. the counteracting seal groove or receiving groove 94, may have similar dimensions of a recess depth to realize the interlocking design. For ease of assembly the receiving seal part 94, i.e. the receiving groove 94, may be formed to be slightly bigger than the protruding lip 92, for example having a recess depth h2 (shown in FIG. 7B) from the surface C2 approximately between 6-11 mm.

The thickness t1 (shown in FIG. 7A) of the projecting seal part 92, i.e. the protruding lip 92, may be between approximately 0.8 mm to 10 mm (measured in the radial direction). The thickness t2 (shown in FIG. 7B) of the receiving seal part 94, e.g. the receiving groove 94, may be between approximately 1 mm to 10.2 mm (measured in the radial direction).

According to an embodiment of the present invention, the diameter D (shown in FIG. 4A) of the stage 1 ring assembly 1 may be between 500 mm and 1300 mm, i.e. the distance between the inner surface 2*x* of one ring segment 2 and the inner surface 2*x* of another ring segment 2 positioned diametrically opposite to the one ring segment 2.

The dimensions as provided hereinabove are exemplary dimensions, and the present invention is not limited thereto. Furthermore, the exemplary dimensions as provided herein are for large industrial gas turbines. Small gas turbines e.g. aero engines (jet engines), small industry gas turbines or helicopter engines may have smaller turbine dimensions; however the same design principle can be applied on such engines as well.

The ring segment 2 of the present invention may be additively manufactured.

LIST OF REFERENCE SIGNS

| | |
|---|---|
| 1 | ring assembly |
| 1' | conventionally known ring assembly |
| 2 | ring segment |
| 2' | conventionally known ring segment |
| 2a | first end of the ring segment 2 |
| 2a' | first end of the ring segment 2' |
| 2b | second end of the ring segment 2 |
| 2b' | second end of the ring segment 2' |
| 2e | radially outer surface of the ring segment 2 |
| 2e' | radially outer surface of the ring segment 2' |
| 2m | first axial surface of the ring segment 2 |
| 2m' | first axial surface of the ring segment 2' |
| 2n | second axial surface of the ring segment 2 |
| 2n' | second axial surface of the ring segment 2' |
| 2x | radially inner surface of the ring segment 2 |
| 2x' | radially inner surface of the ring segment 2' |
| 3 | ring carrier |
| 3a, b | hooks of the ring carrier |
| 5 | annular hot gas path |
| 10 | gas turbine |
| 12 | inlet |

-continued

LIST OF REFERENCE SIGNS

| | |
|---|---|
| 14 | compressor section |
| 16 | combustion section or burner section |
| 17 | transition duct |
| 18 | turbine section |
| 19 | combustor cans |
| 20 | longitudinal or rotational axis |
| 20a | axial direction |
| 20c | circumferential direction |
| 20r | radial direction |
| 22 | shaft |
| 24 | air |
| 26 | burner plenum |
| 28 | combustion chamber |
| 30 | burner |
| 32 | diffuser |
| 34 | combustion gas or working gas |
| 36 | blade carrying discs |
| 38 | turbine blades |
| 38a | tip of the turbine blade |
| 40 | guiding vanes |
| 42 | stator |
| 42a | inner surface of the stator |
| 44 | inlet guiding vanes |
| 46 | vane stages |
| 48 | rotor blade stages |
| 50 | casing |
| 50s | outer space |
| 71 | first fixing part of the ring segment 2 |
| 72 | second fixing part of the ring segment 2 |
| 92 | projecting seal part |
| 92L | protruding lip |
| 94 | receiving seal part |
| 94G | receiving groove |
| 201 | first ring segment |
| 202 | second ring segment |
| 921 | first projecting seal part or lip |
| 922 | second projecting seal part or lip |
| 941 | first receiving seal part or groove |
| 942 | second receiving seal part or groove |
| G | junction or gap between ring segments 2, 2' |
| GR | groove |
| R | rotor |
| S | integrated seal of the ring segments 2 |
| S' | conventionally known seal between the ring segments 2' |

The invention claimed is:

1. A ring assembly for being disposed radially outwardly of an array of circumferentially arranged blades of a rotor of a gas turbine engine, the ring assembly comprising:

a plurality of ring segments disposed circumferentially one adjacent to another, each ring segment having a first end and a second end circumferentially spaced apart from each other;

wherein the first end of a ring segment and the second end of an adjacent ring segment from among the plurality of ring segments are configured to be arranged facing each other, wherein an integrally formed projecting seal part is formed at the first end, wherein an integrally formed receiving seal part is formed at the second end facing the first end, and wherein the receiving seal part is configured to receive the projecting seal part to form a mating connection between the ring segment and the adjacent ring segment.

2. The ring assembly according to claim 1, wherein the integrally formed projecting seal part is formed at the first end of each of the ring segments; and wherein the integrally formed receiving seal part is formed at the second end of each of the ring segments.

3. The ring assembly according to claim 1, wherein the first end comprises a first axial edge and a second axial edge axially spaced apart from each other, and wherein at least a first part of the projecting seal part extends from the first axial edge to the second axial edge of the first end; and wherein the second end comprises a first axial edge and a second axial edge axially spaced apart from each other, and wherein at least a first part of the receiving seal part extends from the first axial edge to the second axial edge of the second end, corresponding to the first part of the projecting seal part.

4. The ring assembly according to claim 1, wherein the first end comprises a first radial edge and a second radial edge radially spaced apart from each other, and wherein at least a second part of the projecting seal part extends towards the first radial edge and/or towards the second radial edge of the first end; and wherein the second end comprises a first radial edge and a second radial edge radially spaced apart from each other, and wherein at least a second part of the receiving seal part extends towards the first radial edge and/or towards the second radial edge of the second end, corresponding to the second part of the projecting seal part.

5. The ring assembly according to claim 4, wherein the first part and the second part of the projecting seal part intersect or join each other; and wherein the first part and the second part of the receiving seal part intersect or join each other, corresponding the first part and the second part of the projecting seal part.

6. The ring assembly according to claim 1, wherein the projecting seal part and the receiving seal part are curved following a circumferential direction along which the plurality of ring segments are disposed.

7. The ring assembly according to claim 1, wherein the projecting seal part is shaped corresponding to a topological skeleton of the first end, and wherein the receiving seal part is shaped corresponding to the shape of the projecting seal part.

8. The ring assembly according to claim 1, wherein the projecting seal part comprises one or more protruding lips emanating outwardly from a circumferential side surface at the first end; and wherein the receiving seal part comprises one or more receiving grooves recessed inwardly from a circumferential side surface at the second end, corresponding to the one or more protruding lips of the projecting seal part.

9. The ring assembly according to claim 8, wherein at least one integrally formed opposing receiving groove is formed at the first end, being recessed inwardly from the circumferential side surface at the first end, and wherein at least one integrally formed opposing protruding lip is formed at the second end, emanating outwardly from the circumferential side surface at the second end, corresponding to the at least one integrally formed opposing receiving groove.

10. The ring assembly according to claim 8, wherein portions of at least two protruding lips of the one or more protruding lips are parallelly disposed and spaced apart from each other; and wherein portions of at least two receiving grooves of the one or more receiving grooves are parallelly disposed and spaced apart from each other, corresponding to the portions of the at least two protruding lips.

11. The ring assembly according to claim 8, wherein the one or more protruding lips comprise at least one of a flat tip, a tapered tip, a rounded tip and a furcated tip; and wherein the one or more receiving grooves are shaped correspondingly to the one more protruding lips.

12. The ring assembly according to claim 1, wherein each of the ring segments has a radially inner gas path surface and a radially outer surface opposite to the gas path surface, wherein at least one of the ring segments comprise one or more fixing parts extending radially outwardly from the outer surface of the ring segment for fixing the ring segment to a ring carrier of a stator of the gas turbine engine; and wherein the projecting seal part and the receiving seal part are formed to extend along a surface of the one or more fixing parts.

13. A gas turbine engine comprising a ring assembly, wherein the ring assembly for being disposed radially outwardly of an array of circumferentially arranged blades of a rotor of a gas turbine engine, the ring assembly comprising:

a plurality of ring segments disposed circumferentially one adjacent to another, each ring segment having a first end and a second end circumferentially spaced apart from each other;

wherein the first end of a ring segment and the second end of an adjacent ring segment from among the plurality of ring segments are configured to be arranged facing each other, wherein an integrally formed projecting seal part is formed at the first end, wherein an integrally formed receiving seal part is formed at the second end facing the first end, and wherein the receiving seal part is configured to receive the projecting seal part to form a mating connection between the ring segment and the adjacent ring segment.

14. The gas turbine engine according to claim 13, wherein the integrally formed projecting seal part is formed at the first end of each of the ring segments; and wherein the integrally formed receiving seal part is formed at the second end of each of the ring segments.

15. The gas turbine engine according to claim 13, wherein the first end comprises a first axial edge and a second axial edge axially spaced apart from each other, and wherein at least a first part of the projecting seal part extends from the first axial edge to the second axial edge of the first end; and wherein the second end comprises a first axial edge and a second axial edge axially spaced apart from each other, and wherein at least a first part of the receiving seal part extends from the first axial edge to the second axial edge of the second end, corresponding to the first part of the projecting seal part.

16. The gas turbine engine according to claim 13, wherein the first end comprises a first radial edge and a second radial edge radially spaced apart from each other, and wherein at least a second part of the projecting seal part extends towards the first radial edge and/or towards the second radial edge of the first end; and wherein the second end comprises a first radial edge and a second radial edge radially spaced apart from each other, and wherein at least a second part of the receiving seal part extends towards the first radial edge and/or towards the second radial edge of the second end, corresponding to the second part of the projecting seal part.

17. The gas turbine engine according to claim 16, wherein the first part and the second part of the projecting seal part intersect or join each other; and wherein the first part and the second part of the receiving seal part intersect or join each other, corresponding the first part and the second part of the projecting seal part.

18. The gas turbine engine according to claim 13, wherein the projecting seal part and the receiving seal part are curved following a circumferential direction along which the plurality of ring segments are disposed.

19. A ring segment of a ring assembly for being circumferentially disposed radially outwardly of an array of blades of a rotor of a gas turbine engine, the ring segment comprising:

a first end and a second end circumferentially spaced apart from each other;

wherein the first end comprises at least one integrally formed protruding lip emanating outwardly from a circumferential side surface at the first end, wherein the second end comprises at least one integrally formed receiving groove recessed inwardly from a circumferential side surface at the second end, and wherein the at least one integrally formed receiving groove is correspondingly shaped so that the shape of the at least one integrally formed receiving groove may mate with the shape of the at least one integrally formed protruding lip.

20. The ring segment according to claim 19, wherein the at least one integrally formed protruding lip and the at least one integrally formed receiving groove are curved following a circumferential direction along which the ring assembly is disposed.

* * * * *